US009914879B2

(12) United States Patent
Otterstrom et al.

(10) Patent No.: US 9,914,879 B2
(45) Date of Patent: Mar. 13, 2018

(54) STAGED ZONE HEATING OF HYDROCARBON BEARING MATERIALS

(71) Applicant: Red Leaf Resources, Inc., Salt Lake City, UT (US)

(72) Inventors: Gary Otterstrom, South Jordan, UT (US); Tom Plikas, Mississauga (CA); Umesh Shah, Mississauga (CA)

(73) Assignee: Red Leaf Resources, Inc., Salt Lake City, UT (US)

( * ) Notice: Subject to any disclaimer, the term of this patent is extended or adjusted under 35 U.S.C. 154(b) by 0 days.

(21) Appl. No.: 15/280,831

(22) Filed: Sep. 29, 2016

(65) Prior Publication Data

US 2017/0088780 A1 Mar. 30, 2017

Related U.S. Application Data

(60) Provisional application No. 62/235,091, filed on Sep. 30, 2015.

(51) Int. Cl.
*C10G 1/00* (2006.01)
*C10G 1/02* (2006.01)

(52) U.S. Cl.
CPC ..... *C10G 1/02* (2013.01); *C10G 2300/4006* (2013.01)

(58) Field of Classification Search
CPC ..... C10G 1/00
See application file for complete search history.

(56) References Cited

U.S. PATENT DOCUMENTS

| | | | | |
|---|---|---|---|---|
| 2,813,583 | A * | 11/1957 | Marx | E21B 41/02 166/271 |
| 3,428,125 | A | 2/1969 | Parker | |
| 3,522,842 | A | 8/1970 | New | |
| RE30,738 | E | 9/1981 | Bridges et al. | |
| 4,301,865 | A | 11/1981 | Kasevich et al. | |
| 4,373,581 | A | 2/1983 | Toellner | |
| 4,396,062 | A | 8/1983 | Iskander | |
| 4,438,816 | A | 3/1984 | Urban et al. | |
| 4,448,668 | A | 5/1984 | Deering | |
| 4,495,990 | A | 1/1985 | Titus et al. | |
| 4,553,592 | A | 11/1985 | Looney et al. | |
| 4,660,636 | A | 4/1987 | Rundell et al. | |
| 5,082,054 | A | 1/1992 | Kiamanesh | |
| 5,236,039 | A | 8/1993 | Edelstein et al. | |
| 6,991,032 | B2 | 1/2006 | Berchenko et al. | |
| 7,073,578 | B2 | 7/2006 | Vinegar et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,225,866 | B2 | 6/2007 | Berchenko et al. | |
| 7,312,428 | B2 | 12/2007 | Kinzer | |
| 7,331,385 | B2 | 2/2008 | Symington et al. | |
| 7,461,693 | B2 | 12/2008 | Considine et al. | |
| 7,562,708 | B2 | 7/2009 | Cogliandro et al. | |
| 7,862,705 | B2 | 1/2011 | Dana et al. | |
| 7,934,549 | B2 | 5/2011 | Cimolai | |
| 8,021,445 | B2 | 9/2011 | Shaffer | |
| 8,082,995 | B2 | 12/2011 | Symington et al. | |
| 8,349,171 | B2 * | 1/2013 | Dana | C10G 1/02 208/400 |
| 8,365,478 | B2 | 2/2013 | Dana et al. | |
| 8,961,652 | B2 | 2/2015 | Patten | |
| 2008/0202985 | A1 | 8/2008 | Hatfield et al. | |
| 2010/0096295 | A1 | 4/2010 | Pringle et al. | |
| 2013/0153210 | A1 | 6/2013 | Menard et al. | |
| 2013/0334106 | A1 | 12/2013 | Patten | |
| 2015/0114885 | A1 | 4/2015 | Keracik | |
| 2015/0204179 | A1 | 7/2015 | Affholter et al. | |
| 2015/0257404 | A1 | 9/2015 | Isenberg et al. | |

OTHER PUBLICATIONS

Kinzer, "A Review of Notable Intellectual Property for In SITU Electromagnetic Heating of Oil Shale" Quasar Energy LLC; 1 Page, (2017).

Office of Technology Assessment, "An Assessment of Oil Shale Technologies." Chapter 5: Technology; United States Government Printing Office; 1980; pp. 117-176.

Wang et al, "A New Idea for In-Situ retorting Oil Shale by Way Of Fluid Heating Technology" Oil Drilling & Production Technology; Production Technology Research Institute Of Huabei Oil Corporation; 2014; vol. 36 Issue 4; pp. 71-74.

* cited by examiner

*Primary Examiner* — Randy Boyer
(74) *Attorney, Agent, or Firm* — Thorpe North & Western, LLP

(57) ABSTRACT

Methods and systems of heating a body of crushed hydrocarbonaceous material to produce hydrocarbons therefrom can involve heating multiple zones of the body of material sequentially. An exemplary method can include forming a body of crushed hydrocarbonaceous material having a first zone and a second zone. The first zone can be heated in a first heating stage to form a dynamic high temperature production region in the first zone. A cooling fluid can then be injected into the first zone after the high temperature production region forms. The high temperature production region can move into the second zone in a second heating stage. Hydrocarbons can be collected from the body of crushed hydrocarbonaceous material during both the first and second heating stages.

10 Claims, 17 Drawing Sheets

STAGED ZONE HEATING OF HYDROCARBON BEARING MATERIALS

RELATED APPLICATION(S)

This application claims the benefit of U.S. Provisional Patent Application Ser. No. 62/235,091, filed on Sep. 30, 2015, which is incorporated herein by reference.

FIELD OF THE INVENTION

The present invention relates to systems and methods for heating hydrocarbon bearing materials to produce hydrocarbons therefrom. Therefore, the invention relates to the fields of hydrocarbon production and heat transfer.

BACKGROUND

Many processes have been developed for producing hydrocarbons from various hydrocarbonaceous materials such as oil shale and tar sands. Historically, the dominant research and commercial processes include above-ground retorts and in-situ processes. More recently, encapsulated impoundments have been developed for recovering oil from crushed oil shale (In-Capsule® technology). These impoundments are formed primarily of earthen materials, with the crushed oil shale being encapsulated by an impermeable barrier made of rock, soil, clay, and geosynthetics, among other materials. The encapsulated impoundments can be very large, sometimes occupying several acres with a depth of tens of meters.

Generally, methods for recovering hydrocarbon products from oil shale have involved applying heat to the oil shale. Heating oil shale allows kerogen in the oil shale to break down through the process of pyrolysis, yielding liquid and vapor hydrocarbon compounds along with other products such as water vapor and residuals. However, the heat needed to pyrolyze oil shale is often provided by burning fossil fuels such as natural gas or a portion of the very hydrocarbons produced from the oil shale. This amounts to a significant energy expense and increases the carbon footprint of oil shale production. Accordingly, research continues into more efficient methods of producing hydrocarbons from oil shale and other hydrocarbonaceous materials.

SUMMARY

Hydrocarbons can be produced by forming a body of crushed hydrocarbonaceous material and applying heat to the crushed hydrocarbonaceous material. The present technology provides methods and systems for selectively heating portions of a body of crushed hydrocarbonaceous material by sequentially heating adjacent zones of the body of crushed hydrocarbonaceous material. The methods and systems can produce hydrocarbons while reducing the overall energy input required. In an example of the present technology, a body of crushed hydrocarbonaceous material having a first zone and a second zone can be formed. A first heating stage can include heating the first zone to form a dynamic high temperature production region in the first zone. After the first heating stage, a second heating stage can include injecting a low temperature fluid into the first zone after the high temperature production region forms. During this stage, the high temperature production region can move into the second zone. During both the first and second heating stages, hydrocarbons can be collected from the body of crushed hydrocarbonaceous material.

In another example of the present technology, a system for heating a body of crushed hydrocarbonaceous material to produce hydrocarbons therefrom can include a body of crushed hydrocarbonaceous material having a lower zone and an upper zone. The system can also include a lower heating conduit embedded in the lower zone and an upper heating conduit embedded in the upper zone. A collection conduit can be embedded in the upper zone at a location above the upper conduit. The system can include valves to control flow of a heat transfer fluid through the heating conduits. A lower heating valve can be used to control flow of the heat transfer fluid to the lower heating conduit. An upper heating valve can be used to control flow of the heat transfer fluid to the upper heating conduit. The valves can be configured to sequentially allow the heat transfer fluid to flow through the lower heating conduit and then through the upper heating conduit or through the upper heating conduit and then through the lower heating conduit.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
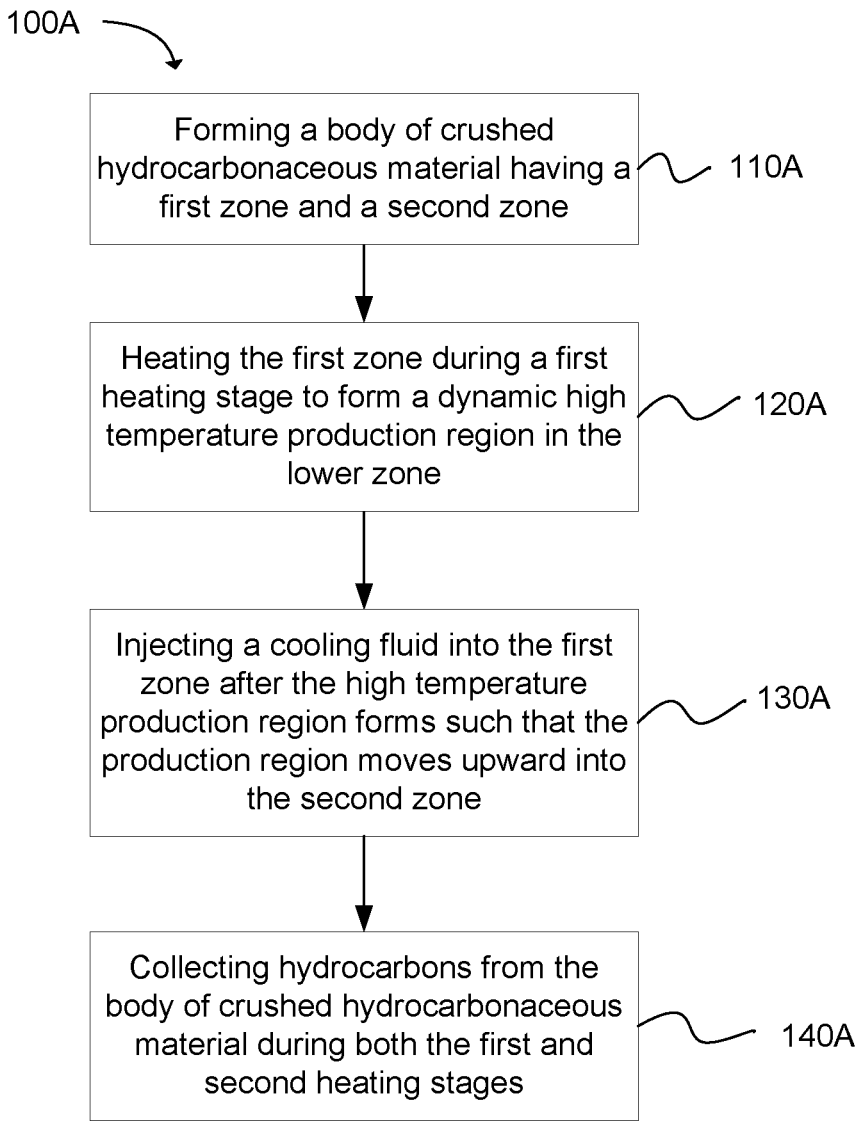
FIG. 1A-1B are flowcharts illustrating a method of heating a body of crushed hydrocarbonaceous material to produce hydrocarbons therefrom, in accordance with an embodiment of the present invention.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

As used herein, "hydrocarbonaceous material" refers to any hydrocarbon-containing material from which hydrocarbon products can be extracted or derived. For example, hydrocarbons may be extracted directly as a liquid, removed via solvent extraction, directly vaporized, by conversion from a feedstock material, or otherwise removed from the material. Many hydrocarbonaceous materials contain kerogen or bitumen which is converted to a flowable or recoverable hydrocarbon through heating and pyrolysis. Hydrocarbonaceous materials can include, but are not limited to, oil shale, tar sands, coal, lignite, bitumen, peat, and other organic rich rock. Thus, existing hydrocarbon-containing materials can be upgraded and/or released from such feedstock through a chemical conversion into more useful hydrocarbon products.

As used herein, "spent hydrocarbonaceous material" and "spent oil shale" refer to materials that have already been used to produce hydrocarbons. Typically after producing hydrocarbons from a hydrocarbonaceous material, the remaining material is mostly mineral with the organic content largely removed.

As used herein, "rich hydrocarbonaceous material" and "rich oil shale" refer to materials that have relatively high hydrocarbon content. As an example, rich oil shale can typically have from 12% to 25% hydrocarbon content by weight, and some cases higher.

As used herein, "non-condensable gases" refer to gases which contain compounds which are not readily condensed such as, but not limited to, nitrogen, carbon dioxide, light hydrocarbons (e.g. methane, ethane, propane, butane, pentane, hexane), and the like.

As used herein, "compacted earthen material" refers to particulate materials such as soil, sand, gravel, crushed rock, clay, spent shale, mixtures of these materials, and similar materials. A compacted earthen material suitable for use in the present invention typically has a particle size of less than about 10 cm in diameter.

As used herein, "dynamic high-temperature production region" refers to a volumetric portion of the body of crushed hydrocarbonaceous material which is maintained at a production temperature sufficient to produce hydrocarbon product. The dynamic production region is maintained and operated so as to dynamically progress or advance through the body of hydrocarbonaceous material across adjacent zones.

As used herein, whenever any property is referred to that can have a distribution between differing values, such as a temperature distribution, particle size distribution, etc., the property being referred to represents an average of the distribution unless otherwise specified. Therefore, "particle size" refers to a number-average particle size, and "temperature of the body of crushed hydrocarbonaceous material" refers to an average temperature of the body of heated material.

It is noted that, as used in this specification and in the appended claims, the singular forms "a," "an," and "the" include plural referents unless the context clearly dictates otherwise. Thus, for example, reference to "a layer" includes one or more of such features, reference to "a particle" includes reference to one or more of such elements, and reference to "producing" includes reference to one or more of such steps.

As used herein, the terms "about" and "approximately" are used to provide flexibility, such as to indicate, for example, that a given value in a numerical range endpoint may be "a little above" or "a little below" the endpoint. The degree of flexibility for a particular variable can be readily determined by one skilled in the art based on the context.

As used herein, the term "substantially" refers to the complete or nearly complete extent or degree of an action, characteristic, property, state, structure, item, or result. The exact allowable degree of deviation from absolute completeness may in some cases depend on the specific context. However, the nearness of completion will generally be so as to have the same overall result as if absolute and total completion were obtained. "Substantially" refers to a degree of deviation that is sufficiently small so as to not measurably detract from the identified property or circumstance. The exact degree of deviation allowable may in some cases depend on the specific context. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context. Additionally, adjacent structures or elements can in some cases be separated by additional structures or elements between the adjacent structures or elements.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Reference will now be made to the exemplary embodiments illustrated, and specific language will be used herein to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the technology.

With the general examples set forth in the Summary above, it is noted in the present disclosure that when describing the system, or the related devices or methods, individual or separate descriptions are considered applicable to one other, whether or not explicitly discussed in the context of a particular example or embodiment. For example, in discussing a device per se, other device, system, and/or method embodiments are also included in such discussions, and vice versa.

Furthermore, various modifications and combinations can be derived from the present disclosure and illustrations, and as such, the following figures should not be considered limiting.

Staged Zone Heating of Hydrocarbon Bearing Materials

The present technology provides methods and systems for heating a body of crushed hydrocarbonaceous material to produce hydrocarbons from the material. Some previous technologies for producing hydrocarbons from hydrocarbonaceous material have involved heating a body of hydrocarbonaceous material for a period of time. However, the entire body of hydrocarbonaceous material has typically been heated to a roughly uniform temperature during the production process. In contrast, the methods of the present invention involve heating multiple zones of the body of crushed hydrocarbonaceous material at different times. These zones can be portions of the body of hydrocarbonaceous material that are stacked vertically. For example, the body of crushed hydrocarbonaceous material can be divided into at least a lower zone and an upper zone, although there can be any number of additional intermediate zones. These zones can be heated sequentially, starting from the lower zone and moving upward or starting from the upper zone and moving downward. Adjacent zones are also typically not physically separated from one another by a barrier, and in some cases the zones have substantially similar composition, porosity and particle size to one another.

Heating the body of crushed hydrocarbonaceous materials in sequentially heated zones can reduce the overall energy input required to produce hydrocarbons from the material. Thus, the methods and systems provided by the present technology can improve the production efficiency of hydrocarbons from hydrocarbonaceous material. In some examples, the first zone can be heated so that a region of higher temperature forms in the first zone. In some cases, the first zone can be heated by flowing heated gas into the first zone. The temperature of the heated gas can be such that the hydrocarbonaceous material in the first zone reaches a production temperature sufficient to produce hydrocarbon products. The flow rate of the heated gas can be sufficient to maintain the hydrocarbonaceous material in the first zone at the production temperature for a time sufficient to produce a desired amount of hydrocarbons. This high temperature region can be characterized by convective flow and forced flow of heated fluid through void spaces between particles of crushed hydrocarbonaceous material. The fluid can include hydrocarbons liberated from the hydrocarbonaceous material, injected heat transfer fluid, or most often combinations of both fluids.

After heating the first zone of the body of crushed hydrocarbonaceous material to form a high temperature production region, a relatively cooler fluid can be injected into the first zone after the high temperature production region. Typically, the cooler fluid can be any fluid introduced at a temperature lower than the production temperature maintained in the production region. As the cooler fluid is injected, the cooler fluid can displace the hot fluid in the high temperature production region to create forced mass flow through the production region into adjacent zones toward a collection point. As heat is transferred between the fluids and the solid hydrocarbonaceous material, the cooler fluid can draw heat out of the hot hydrocarbonaceous material in the first zone, while the displaced hotter fluids begin to transfer heat to hydrocarbonaceous material in a second zone of the body of crushed hydrocarbonaceous material. Thus, heat from the spent hydrocarbonaceous material in the first zone can be reclaimed and redirected to aid in production of hydrocarbons from the hydrocarbonaceous material in the second zone. As the first zone cools and the second zone is heated, the high temperature production region effectively progressively migrates from the first zone into the second zone.

Depending on the desired operation parameters of the system, the high temperature production region can move upward or downward through the body of crushed hydrocarbonaceous material. In some examples, heating can begin at the bottom of the body of crushed hydrocarbonaceous material and then cooler fluids can be injected into the bottom zone to move the high temperature production region upward. In other examples, heating can begin at the top of the body and then cooler fluid can be injected at the top to move the high temperature production region downward. Regardless, as the high temperature production region moves from the first zone into the second zone, the crushed hydrocarbonaceous material in the second zone increases in temperature up to a sufficient temperature for hydrocarbon production. In some cases, additional supplemental heat can be added to the second zone as described in more detail below.

Consistent with these principles, thermal energy can be introduced via closed heating loops or injection of a heating fluid directly into the crushed hydrocarbonaceous material. As the hydrocarbonaceous material is heated, hydrocarbon product is formed. Accordingly, convective heat transfer and mass transfer occur simultaneously, along with concomitant buoyancy effects. Mass transfer rates can be a function of flow provided by injected heating fluid (e.g. optionally recycled non-condensable hydrocarbon product) and currently produced hydrocarbon product (e.g. non-recycled hydrocarbon product). Thus, thermal energy input into the production region can be maintained for a desired period of time to facilitate production of a desired amount of hydrocarbon product from that zone.

Ideally, this results in 100% conversion of hydrocarbonaceous precursors to hydrocarbon product. However, in practice, only a portion of potential materials are produced due to a variety of reasons. Regardless, as hydrocarbon products are produced, mass transfer rates can be used to draw hydrocarbon product through and out of the body at a collection point, while also balancing heat transfer rates into and out of the production region. As the zone becomes depleted, input thermal energy rates and mass flow rates can be adjusted to allow the dynamic high temperature production region to migrate or advance to an adjacent zone. This can be accomplished by injecting the cooling fluid as described herein. As cooling fluid passes through the region, heat is initially captured by the cooling fluid at a receding edge of the production region and transferred toward an advancing front of the production region through the body. Consequently, the dynamic high-temperature production region can advance through the body of hydrocarbonaceous material along sequential adjacent zones.

Notably, heating fluid and cooling fluid mass flow rates (i.e. space velocity) can be maintained so as to achieve the desired advancement of the thermally defined production region, while also avoiding formation of so-called Rayleigh-Bernard convection. Such Rayleigh-Bernard convection can result in undesirable bulk mass and heat flow opposite a desired direction, depending on the direction of operation. Accordingly, heating fluid, cooling fluid, and hydrocarbon products will generally flow along a common bulk direction through the body of hydrocarbonaceous material. In contrast, although heating fluid and hydrocarbon products can pass through the production region, the thermally-defined production region can remain static or progressively migrating slowly through the body at a distinct and substantially slower rate.

Heating the body of crushed hydrocarbonaceous material in zones using the methods described herein can increase the efficiency of hydrocarbon production. In some cases, the total amount of energy used to heat the crushed hydrocarbonaceous material can be reduced, compared to processes in which the entire body of crushed hydrocarbonaceous material is heated simultaneously. When multiple zones of the material are heated sequentially, the overall average temperature of the body of material is lower than when the entire body is heated simultaneously. Additionally, injecting cooling fluid after the high temperature production region can increase efficiency by recovering some heat from the spent hydrocarbonaceous material in the first zone to be used for heating the second zone. This can also provide the advantage of a cooler overall temperature of the body of crushed hydrocarbonaceous material at the end of the hydrocarbon production process. Therefore, less cooling can be required to reduce the temperature of the hydrocarbonaceous material to a temperature suitable for reclamation and/or shutdown.

In some examples, hydrocarbons can be collected constantly throughout the heating stages from a location in the lower or upper zone. The hydrocarbons collected from the zones can include gaseous hydrocarbons. The collection of hydrocarbons from the second zone can help to draw the high temperature production region to the second zone as the cooling fluid is injected to relocate the high temperature production region. In further examples, gaseous products and liquid hydrocarbons can be collected from other locations including any intermediate zones of the body of crushed hydrocarbonaceous material.

In certain examples, the methods described herein can be applied to an in-capsule hydrocarbon production system, similar to the systems described in U.S. Pat. No. 7,862,705, which is incorporated herein by reference. In these examples, the body of crushed hydrocarbonaceous material can be formed inside an impoundment that prevents uncontrolled migration of gases and liquids into and out of the impoundment. The impoundment can include walls having multiple layers comprising particulate earthen materials as described in more detail below.

With the above description in mind, FIG. 1A is a flowchart illustrating a method 100A of heating a body of crushed hydrocarbonaceous material to produce hydrocarbons therefrom, in accordance with an embodiment of the present invention. The method includes forming a body of crushed hydrocarbonaceous material having a lower zone and an upper zone 110A; heating the lower zone during a first heating stage to form a high temperature production region in the lower zone 120A; injecting a cooling fluid into the lower zone below the high temperature production region in a second heating stage such that the high temperature production region moves upward into the upper zone 130A; and collecting hydrocarbons from the body of crushed hydrocarbonaceous material during both the first and second heating stages 140A.

Figure 1B:
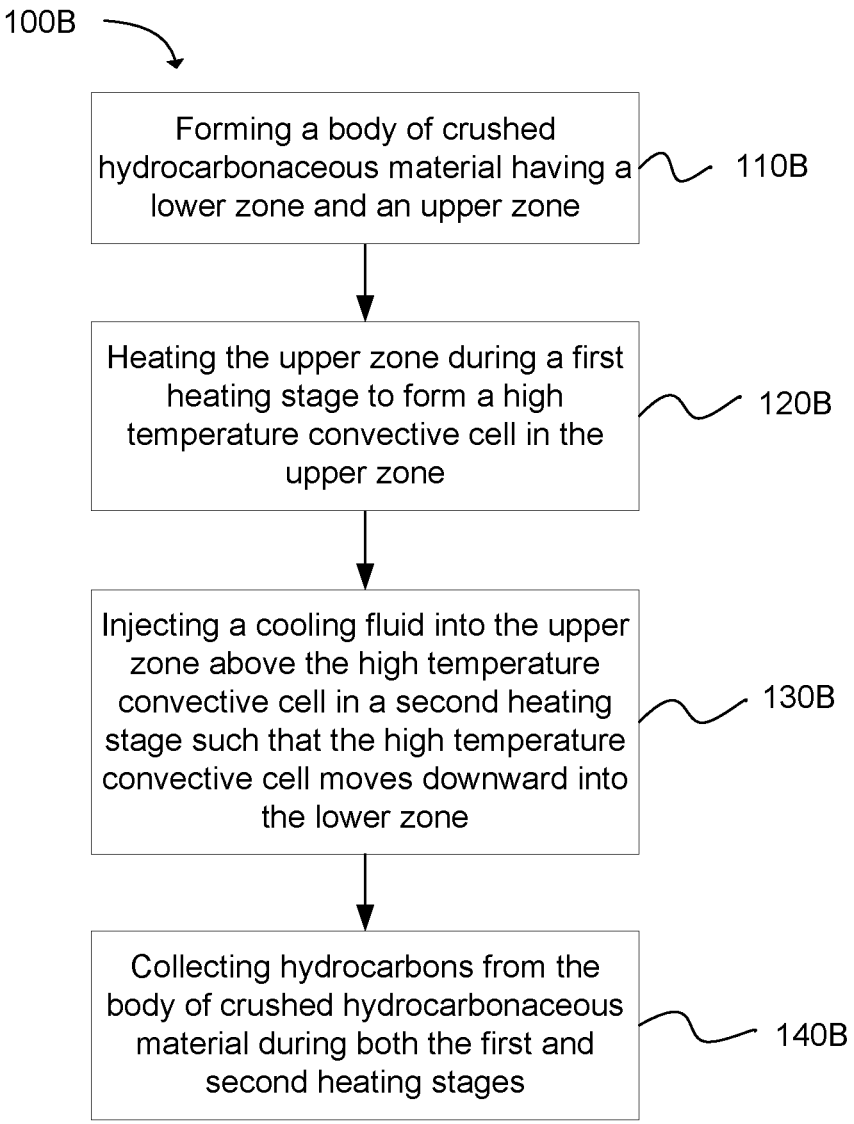

In a similar depiction, FIG. 1B is a flowchart illustrating a method 100B of heating a body of crushed hydrocarbonaceous material to produce hydrocarbons therefrom. The method includes forming a body of crushed hydrocarbonaceous material having a lower zone and an upper zone 110B;

heating the upper zone during a first heating stage to form a high temperature production region in the upper zone 120B; injecting a cooling fluid into the upper zone above the high temperature production region in a second heating stage such that the high temperature production region moves downward into the lower zone 130B; and collecting hydrocarbons from the body of crushed hydrocarbonaceous material during both the first and second heating stages 140B.

In some examples, the body of crushed hydrocarbonaceous material can be formed from a material such as mined oil shale, tar sands, lignite, bitumen, coal, peat, harvested biomass, or another hydrocarbon-rich material. The crushed hydrocarbonaceous material can be contained by an impoundment that forms an impermeable barrier encapsulating the body of the crushed hydrocarbonaceous material. In some cases, the size of the impoundment can be relatively large. Larger impoundments or systems with multiple impoundments can readily produce hydrocarbon products and performance comparable to or exceeding smaller impoundments. As an illustration, single impoundments can range in size from 15 meters across to 200 meters, and often from about 100 to 160 meters across. Optimal impoundment sizes may vary depending on the hydrocarbonaceous material and operating parameters, however suitable impoundment areas can often range from about one-half to ten acres in top plan surface area. Additionally, the impoundment can have a depth from about 10 m to about 50 m.

The body of hydrocarbonaceous material can also be formed a comminuted particulate material sized to obtain a desired target void space. Bodies suitable for use in the present invention can have greater than about 10% void space and typically have void space from about 20% to 50%, although other ranges may be suitable such as up to about 70%. Allowing for high permeability facilitates heating of the body through convection as the primary heat transfer mechanism while also substantially reducing costs associated with crushing to very small sizes, e.g. below about 2.5 to about 1 cm. Specific target void space can vary depending on the particular hydrocarbonaceous material and desired process times or conditions. Particle sizes throughout the permeable body can vary considerably, depending on the material type, desired heating rates, and other factors. As a general guideline, the permeable body can include comminuted hydrocarbonaceous particles up to about 2 meters on average, and in some cases less than 30 cm and in other cases less than about 16 cm on average. However, as a practical matter, maximum particle sizes can range from about 5 cm to about 60 cm, or in one aspect about 16 cm to about 60 cm, can provide good results with about 30 cm average diameter being useful for oil shale especially. Optionally, the body can include bi-modal or multi-modal size distributions in order to provide increased balance of void space and exposed particulate surface area.

The impoundment can include a barrier layer to prevent escape of produced hydrocarbons and heating fluids from the impoundment, while also preventing entrance of air or other unwanted fluids from the environment. Generally, the impoundment can include a floor portion, a ceiling portion, and a sidewall portion connecting the floor and the ceiling to form an enclosed volume which contains the crushed hydrocarbonaceous materials and which restricts flow of fluid outside the impoundment. The ceiling portion defines an upper portion of the enclosed volume and is contiguous with the sidewall. The floor is also contiguous with the sidewall and can be substantially horizontal or sloped toward a drain as desired for the collection of hydrocarbon fluids extracted during processing of the hydrocarbonaceous materials.

In some embodiments, the impoundment can be formed along walls of an excavated hydrocarbonaceous material deposit. For example, oil shale, tar sands, or coal can be mined from a deposit to form a cavity that corresponds approximately to a desired encapsulation volume for the impoundment. The excavated cavity can then be used as a support for the floor and walls of the impoundment. In an alternative embodiment, a berm can be formed around the outside wall surface of the impoundment if the impoundment is partially or substantially above ground level. An impoundment can be a part of an above-ground, free-standing construction with berms supporting the side walls and the floor of the impoundment being supported by the ground beneath the impoundment.

The impoundment can be substantially free of undisturbed geological formations. Specifically, the impoundment can be completely constructed and manmade as a separate isolation mechanism for containing the body of crushed hydrocarbonaceous material and preventing uncontrolled migration of fluids into or out of the body of crushed hydrocarbonaceous material. Undisturbed geological formations can have cracks and pores that can make the formations permeable to liquids and gases. Forming the impoundment as a completely manmade structure, without using undisturbed geological formations as the floor or walls, can reduce the risk of any liquids or gases seeping through the geological formations. However, in some embodiments the impoundment can employ some elements of the surface of an excavated geological formation. For example, in some formations, the floor and walls of the excavation might have sufficiently low natural permeability that an additional barrier layer may not be necessary for portions of the impoundment.

The impoundment can generally include a floor, a sidewall extending upwardly from the floor and a ceiling extending over the sidewall to define an enclosed volume. Each of the floor, sidewall and ceiling can be made up of a multiplicity of layers including an inner layer of fines or other insulation material and an outer layer of a swelling clay amended soil or similar fluid barrier material. Optionally, an outer membrane that further prevents passage of fluids outside the impoundment can be employed as a fluid barrier in addition to the swelling clay amended soil. The outer membrane can serve as a secondary back-up seal layer should the primary seal layer fail for any reason. An inner layer of high temperature asphalt or other fluid barrier material may also be optionally applied to the inner surface of the fines layer and define the inner surface of the impoundment.

Swelling clays are inorganic materials that can be hydrated, causing the clay to swell or otherwise create a barrier to fluid flow. The impoundment can include a barrier layer formed with particles of dry clay and other earthen materials, and then the clay can be hydrated to cause the clay particles to swell and create a barrier. Typically such a barrier layer can be formed of a solid phase of particles and a liquid phase of water which collectively form a substantially continuous fluid barrier. For example, the floor, walls, and ceiling of the barrier layer can be formed using a swelling clay amended soil. When the swelling clay is hydrated, it swells and fills up the void spaces between particles of other materials in the soil. In this way the swelling clay amended soil becomes less permeable to fluids. With a sufficient mixture of swelling clays and other earthen materials, the barrier layer can be substantially impermeable to fluid flow. Some examples of suitable swelling clays include bentonite clay, montmorillonite, kaolinite, illite, chlorite, vermiculite, argillite, smectite, and others.

The combined multilayers forming the impoundment can also serve to insulate the body of hydrocarbonaceous material so that heat within the enclosed volume is retained to facilitate the removal of hydrocarbons from the hydrocarbonaceous material. In some examples, the impoundment can include a layer of fines, such as gravel or crushed spent oil shale, to insulate the impoundment. This fines layer can have a temperature gradient across the layer sufficient to allow the swelling clay amended soil layer to be cool enough to remain hydrated. The material forming the fines layer can be a particulate material of less than about 3 cm in diameter.

The impoundment can be formed using any suitable approach. However, in one aspect, the impoundment is formed from the floor up. The formation of the wall or walls and forming the body of crushed hydrocarbonaceous material within the walls can be accomplished simultaneously in a vertical deposition process where materials are deposited in a predetermined pattern. For example, multiple chutes or other particulate delivery mechanisms can be oriented along corresponding locations above the deposited material, By selectively controlling the volume of particulate delivered and the location along the aerial view of the system where each respective particulate material is delivered, the layers and structure can be formed simultaneously from the floor to the ceiling. The sidewall portions of the impoundment can be formed as a continuous upward extension at the outer perimeter of the floor and each layer present, including the swelling clay amended soil layer, fines layer, and, if present membrane and/or asphalt liner, are constructed as a continuous extension of the floor counterparts. During the building up of the sidewall, the crushed hydrocarbonaceous material can be simultaneously placed on the floor and within the sidewall perimeter such that the volume that will become the enclosed space is being filled simultaneously with the rising of the constructed sidewall. In this manner, internal retaining walls or other lateral restraining considerations can be avoided. This approach can also be monitored during vertical build-up in order to verify that intermixing at interfaces of layers is within acceptable predetermined tolerances (e.g. to maintain functionality of the respective layer). For example, excessive intermingling of swelling clay amended soil with fines may compromise the sealing function of the swelling clay amended soil layer. This can be avoided by careful deposition of each adjacent layer as it is built up and/or by increasing deposited layer thickness.

As the build-up process nears the upper portions, the ceiling can be formed using the same delivery mechanisms described above and merely adjusting the location and rate of deposition of the appropriate material forming the ceiling layer. For example, when the desired height of the sidewall is reached, a sufficient amount of the impoundment materials can be added to form a ceiling.

As shown in FIG. 1, after forming the body of crushed hydrocarbonaceous material 110, the lower zone of the body of crushed hydrocarbonaceous material can be heated to form a high temperature production region 120. The lower zone can generally be any lower portion of the body of crushed hydrocarbonaceous material. In some examples, the lower zone can be a horizontal layer extending from the bottom of the body of crushed hydrocarbonaceous material to a height somewhere below the top of the body of crushed hydrocarbonaceous material. In embodiments in which the body of crushed hydrocarbonaceous material is contained in an impoundment, the lower zone can extend from the floor of the impoundment to a height below the ceiling of the impoundment. Similarly, the upper zone of the body of crushed hydrocarbonaceous material can extend from the top of the lower zone up to the ceiling of the impoundment. In other examples, one or more additional intermediate zones can be oriented between the lower zone and the upper zone. Each of these zones can be a substantially horizontal layer, or slice, of the body of crushed hydrocarbonaceous material. In certain examples, the high temperature production region can occupy from about one fourth to about one half of the volume of the body of crushed hydrocarbonaceous material. In a specific example the high temperature production region can occupy approximately one third of the volume of the body. Thus, the lower zone can be the bottom third of the body, the upper zone can be the topmost third of the body, and the middle third of the body can be an intermediate zone. According to some examples of the present invention, the zones can be heated sequentially, starting at the lower zone and then progressing upward to the upper zone. Similarly, the zones can be heated starting at the upper zone and progressing downward to the lower zone as depicted in FIG. 1A.

In some embodiments, one or more heating conduits can be embedded in the lower or upper zone to heat the respective zone, forming the high temperature production region. The heating conduits can be closed loop or open loop heating conduits. Closed loop heating conduits can heat the hydrocarbonaceous material by indirect heating. A heat transfer fluid can be flowed through the closed loop heating conduits and transfer heat through the walls of the conduits to the body of crushed hydrocarbonaceous material. This can raise the temperature of the solid hydrocarbonaceous material and any fluids in interstitial spaces between particles of hydrocarbonaceous material, such as air or gaseous hydrocarbons. Thus, a high temperature production region can be formed.

Heat transfer fluids for use with closed loop heating conduits can include any fluid that is convenient to flow through the conduits. In some examples, the heat transfer fluid can be selected from air, water, saturated steam, superheated steam, organic oils, silicone oils, glycols, molten salts, carbon dioxide, light hydrocarbons, hydrogen and combinations thereof.

In embodiments including open loop heating conduits, the body of crushed hydrocarbonaceous material can be heated by direct heating. Open loop heating conduits can include perforations for injecting a heat transfer fluid into the body of crushed hydrocarbonaceous material. Compared to closed loop heating, open loop heating can theoretically provide an infinite heat transfer area, so a smaller number of conduits and smaller diameter conduits can be used. In some cases, a combination of open loop heating conduits and closed loop heating conduits can be used. For example, open loop direct heating via injection of heat transfer fluid in the lower zone with closed loop heating oriented within the upper zone to maintain desired temperatures.

Heat transfer fluids for use with open loop heating conduits can include any fluid that is compatible with the hydrocarbonaceous material being heated. In some cases, air can be avoided when the hydrocarbonaceous material is at a high temperature to avoid oxidation or combustion of the hydrocarbons being produced. In certain examples, a non-oxidizing heat transfer fluid such as steam can be used to directly heat the body of crushed hydrocarbonaceous material. Other heat transfer fluids that can be used include air at temperatures below a combustion temperature of the hydrocarbonaceous material, hydrogen, and hydrocarbons such as recycled light hydrocarbons produced from the hydrocarbonaceous material. In certain examples, non-condensable hydrocarbons produced from the hydrocarbonaceous material can be recycled and re-injected into the body of crushed hydrocarbonaceous material as a heating or cooling fluid. During heating, the recycled non-condensable hydrocarbons can be heated to a production temperature and then injected into the body. When used as a cooling fluid, the non-condensable hydrocarbons can be re-injected without being heated. Thus, the non-condensable hydrocarbons can be cooled before reinjecting into the body of crushed hydrocarbonaceous materials. In one example, the non-condensable hydrocarbon product can be reinjected as the cooling fluid at a temperature from 100° F. (37.8 C.) to 200° F. (93.3 C.), and in one specific example, at 130° F. (54.4 C.).

Figure 2A:
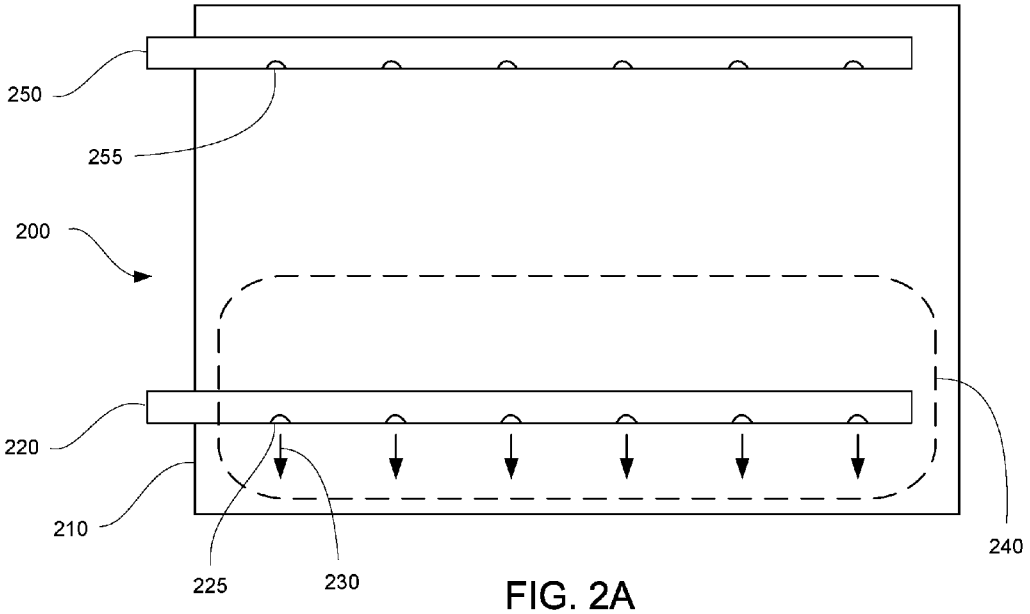
FIGS. 2A-2C are schematic illustrations showing a system for heating a body of crushed hydrocarbonaceous material as a dynamic high temperature production region moves from a lower zone of the body to an upper zone of the body, in accordance with an embodiment of the present invention.
Figure 2B:
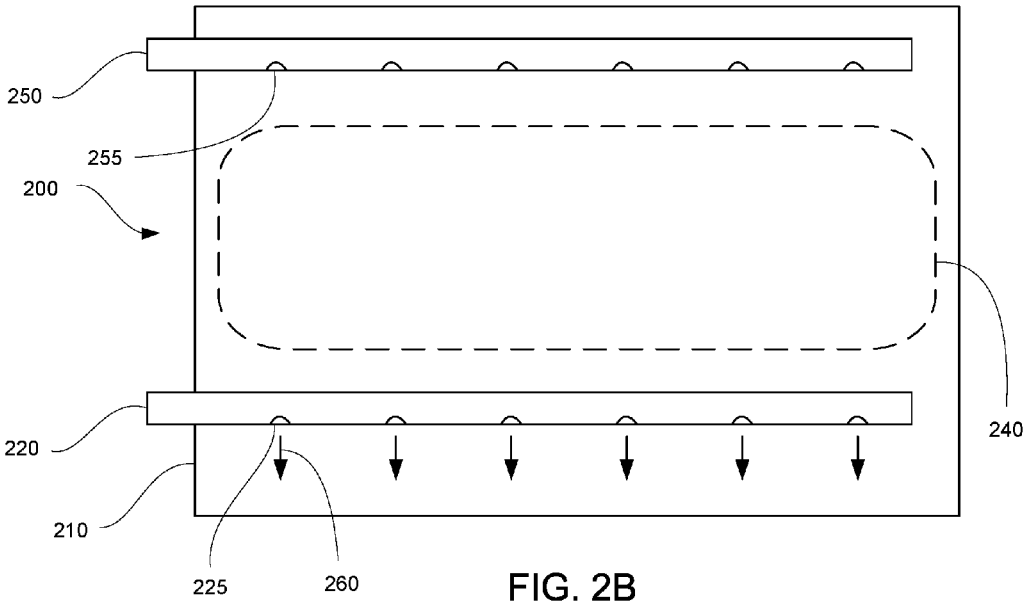
Figure 2C:
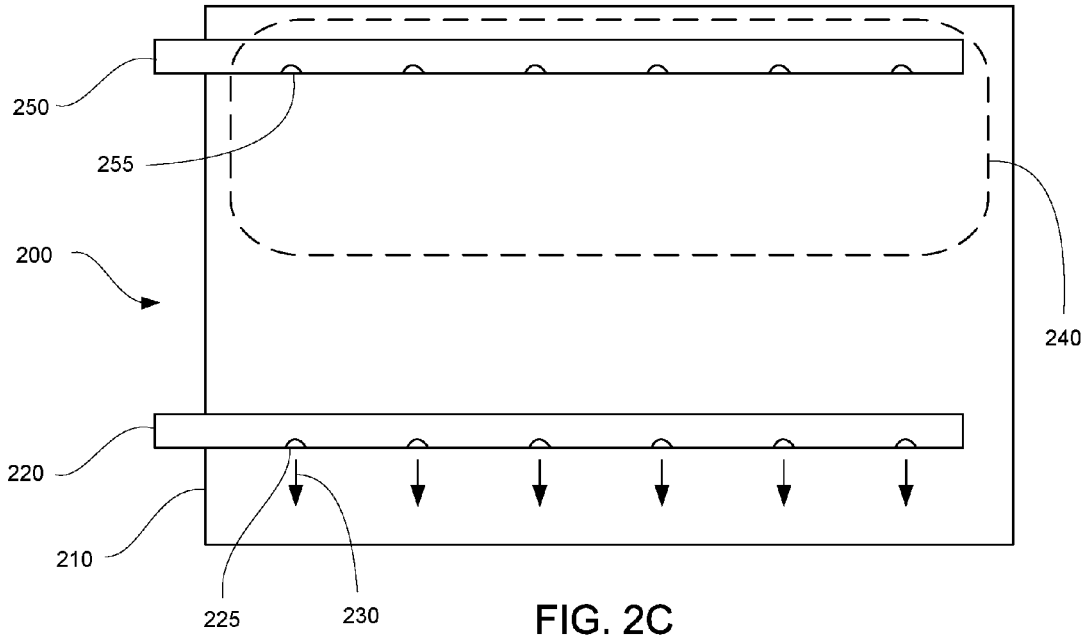

FIGS. 2A-2C are schematic illustrations showing a system 200 for heating a body of crushed hydrocarbonaceous material as a high temperature production region moves from a lower zone of the body to an upper zone of the body. The high temperature production region can also be formed in an upper zone in which case the production region moves from an upper zone of the body to a lower zone of the body. In FIG. 2A, a body of crushed hydrocarbonaceous material 210 includes a lower zone with a direct heating conduit 220 embedded therein. The direct heating conduit includes perforations 225 used to inject a heat transfer fluid 230 (designated by arrows extending from the perforations). Injecting the heat transfer fluid forms a high temperature production region 240 in the lower zone. The system also includes a collection conduit 250 embedded in an upper zone, with collection perforations 255 for collecting hydrocarbons produced from the hydrocarbonaceous material. As the process begins, the collection conduit can also collect air that is displaced from within the body of crushed hydrocarbonaceous material as the heat transfer fluid is injected.

FIG. 2B shows a second heating stage in which a cooling fluid 260 (designated by arrows extending from the perforations 225 in the direct heating conduit 220) is injected into the lower zone. As the cooling fluid is injected, the high temperature production region 240 rises toward the upper zone of the body of crushed hydrocarbonaceous material 210. In the particular embodiment shown, the direct heating conduit is used for the injection both the heat transfer fluid and the cooling fluid. However, in other embodiments, separate injection conduits for heat transfer fluid and cooling fluid can be used.

FIG. 2C shows the end of the second heating stage in which the high temperature production region 240 has risen into the upper zone of the body of crushed hydrocarbonaceous material 210. The high temperature production region can move at a rate sufficiently slow to allow the crushed hydrocarbonaceous material within the production region to be heated to a production temperature, i.e., a temperature at which hydrocarbons can be produced from the hydrocarbonaceous material. The rate of movement of the production region can be controlled by the rate of injection of cooling fluid.

The high temperature production region can move slowly so that the total heating time of the body of crushed hydrocarbonaceous material is relatively long. For example, in some examples the heating time can be from about 3 days to about 2 years. In other examples, the heating time can be from about 3 months to about 1 year. In some embodiments, the heating time can be sufficient to recover most of the hydrocarbons from the hydrocarbonaceous material. In one example, the heating time can be sufficient to recover at least about 70% by weight, and in some cases at least about 90% by weight of the convertible hydrocarbons from the hydrocarbonaceous material. Long heating times used in conjunction with moderate temperatures can in some cases produce better quality hydrocarbon products than shorter heating times with higher temperatures.

The rate of movement of the high temperature production region can be related to the flow rate of fluid injected into the body of crushed hydrocarbonaceous material. The flow rate of fluids moving through the body of crushed hydrocarbonaceous material can be quantified as a space velocity. As used herein, "space velocity" refers to the quotient of the volumetric flow rate of fluids injected into the body of crushed hydrocarbonaceous material divided by the volume of the body of crushed hydrocarbonaceous material. Space velocity has dimensions of $time^{-1}$. In some embodiments, the space velocity of fluids injected into the body of crushed hydrocarbonaceous material can be from 0.1 $hr^{-1}$ to 0.6 $hr^{-1}$.

In further examples, the flow rate of fluid injected into the body of crushed hydrocarbonaceous material can be sufficient to substantially maintain unidirectional flow within the body of crushed hydrocarbonaceous material. This means that a majority (such as greater than 80 vol. % or greater than 90 vol. %) of fluid occupying the volume between particles of crushed hydrocarbonaceous is flowing in one common direction, from a location of heating/cooling fluid injection toward a collection location where the fluid and hydrocarbon products are removed from the system. In one example, the flow rate of injected fluid can be great enough to prevent the formation of convective circulation due to temperature differences within the body of crushed hydrocarbonaceous material. In some cases, when the flow rate of injected fluid is too slow, convective currents may form within the body of crushed hydrocarbonaceous material especially when a hotter zone is located below a cooler zone. In this situation, buoyancy forces can cause hot gases to rise upward and then circulate back downward as the gases cool. Thus, in some examples the flow rate of injected fluid can be faster than a rate at which such convective flow would occur, so that such convective flow is substantially reduced or prevented. In this way, the hottest fluids can be maintained within the production zone of the body of crushed hydrocarbonaceous material so that the hydrocarbons can be recovered from the hydrocarbonaceous material more efficiently.

Figure 3:
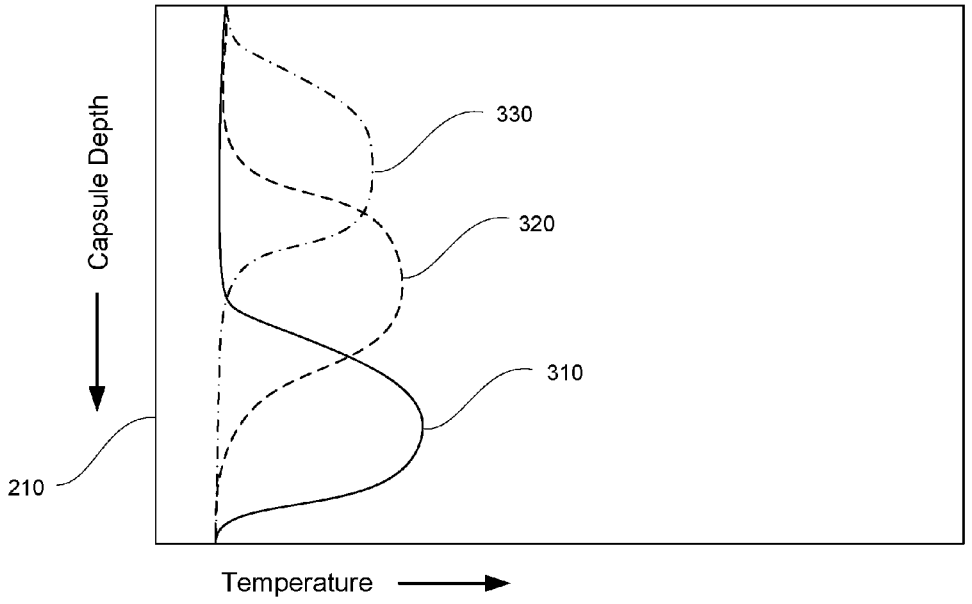
FIG. 3 is a graph representing model temperature profiles superimposed over a body of crushed hydrocarbonaceous material as a high temperature production region moves as a function of time, in accordance with an embodiment of the present invention.

FIG. 3 shows model temperature profiles superimposed over the body of crushed hydrocarbonaceous material 210 during the heating stages described above. A temperature profile during the first heating stage 310 shows higher temperatures within the high temperature production region in the lower zone. A temperature profile at the beginning of the second heating stage 320 shows the region of higher temperature moving upward into the upper zone. Then, a temperature profile later in the second heating stage 330 shows the region of higher temperature within the upper zone. Each temperature profile represents temperature along the horizontal x-axis, while the height within the body of crushed hydrocarbonaceous material is represented as the height at which the temperature profile is superimposed over the body of crushed hydrocarbonaceous material along the vertical y-axis. It should be noted that the figure represents a simplification of temperature profiles in a single embodiment, and the present invention covers a variety of other temperature profiles and methods of sequential heating as well. For example, the illustrated profiles shows an average high temperature which decreases over time with successive stages. However, supplemental intermediate heating can be used to adjust the average temperature of the production region as it moves upward or downward through the body of crushed hydrocarbonaceous material. Similarly, the high temperature production region may broaden during upward or downward flow of the production region. For example, an initial production region occupying 10% of the vertical height may broaden to a final terminal height of 20% at an uppermost or lowermost zone. However, without additional energy input, this would also result in a decreased average high temperature. Such decrease in operating temperature of the production region may be acceptable as long as a minimum operating temperature is maintained within the production region sufficient to produce desired hydrocarbons.

In addition to the lower and upper zones of the body of crushed hydrocarbonaceous material, the body can also include one or more intermediate zones. The high temperature production region can move through each of the intermediate zones so that the crushed hydrocarbonaceous material in the intermediate zones is heated to a sufficient temperature to produce hydrocarbons therefrom. The production region can also move sufficiently slowly that the hydrocarbonaceous material remains at a production temperature for a sufficient time to remove a majority of the hydrocarbons contained in the hydrocarbonaceous material. In some examples, at least about 70% by weight, and in some cases at least about 99% by weight of the convertible hydrocarbons contained in the hydrocarbonaceous material can be liberated and collected.

In some cases, the high temperature production region can tend to decrease in temperature over time as cool crushed hydrocarbonaceous material absorbs heat from the fluids in the production region. Thus, it is possible that the temperature of the production region can fall below the desired production temperature in an intermediate zone or the upper or lower zone. Therefore, in some embodiments the temperature of the production region can be boosted by supplementally heating the zone where the production region is located. When supplemental heating is used, the total amount of energy required to reach the production temperature in the zone can generally be less because the zone can already be heated to near the production temperature by the production region. In some examples, supplemental heating can be used to ensure that each zone is heated to a roughly uniform production temperature, while the moving high temperature production region greatly reduces that total energy input required to heat each zone to the production temperature.

Generally, the high temperature production region can occupy a vertical layer corresponding to a portion of the entire body of crushed hydrocarbonaceous materials. The vertical layer can often occupy from about 5% to 50% of the vertical depth of the body of crushed hydrocarbonaceous materials. In some cases the vertical layer and production region can occupy from about 8% to about 25% of the vertical depth.

The target production temperature can vary considerably depending on the type of hydrocarbonaceous material being processed and the desired type of hydrocarbon products. In some cases, the temperature and pressure conditions in the body of crushed hydrocarbonaceous materials can be maintained so that predominantly gaseous hydrocarbon products are produced, with little or no liquid hydrocarbons produced. Generally, the production temperature can be from about 200° C. to about 550° C. In more specific examples, the production temperature can be from about 350° C. to about 450° C. In still further examples, the production temperature can be from about 200° C. to about 400° C.

The pressure within the body of crushed hydrocarbonaceous material can be maintained from about 1 atm to about 1.4 atm, and often about 1 atm to 1.1 atm, although other pressures may be suitable.

The intermediate and upper or lower zones can be supplementally heated by additional heating conduits embedded in the intermediate and upper or lower zones. The heating conduits can heat the zones by direct or indirect heating. In some cases, the heating conduits can be configured to directly heat the zones by injection of heat transfer fluid. As the high temperature production region moves into a particular zone, that zone can be supplementally heated by injecting additional heat transfer fluid. This heat transfer fluid can augment the high temperature production region, ensuring that the high temperature production region remains at a production temperature. In further examples, the heating conduits can be used for both injection of heat transfer fluid and injection of cooling fluid. In on embodiment, an intermediate zone can be supplementally heated by injecting heat transfer fluid into the intermediate zone. Following this supplemental heating, the same conduit can be used to inject a cooling fluid as the high temperature production region moves out of the intermediate zone and into the next zone. Alternatively, cooling fluid can be injected using the conduits embedded in the first zone, even after heating the intermediate zone.

During the production process, hydrocarbons products can be collected from one or more locations within the body of crushed hydrocarbonaceous materials. The collection can occur during any or all of the first heat stage, second heating stage, and any intermediate heating stages for supplementally heating intermediate zones. In some embodiments, liquid hydrocarbons can be collected from a location in the lower zone. For example, the body of crushed hydrocarbonaceous material can be within an impoundment with a drain in the floor of the impoundment for collecting liquid hydrocarbons. In a further embodiment, the floor of the impoundment can be sloped to direct liquid hydrocarbons toward the drain. In another embodiment, a drain pan can be embedded in the lower zone to collect liquid hydrocarbons.

Additionally, liquid and gaseous hydrocarbons can be collected from other locations within the body of material. For example, collection conduits can be placed in the upper zone and in intermediate zones to collect hydrocarbons from multiple locations. In some cases, the same conduits used for injecting heat transfer fluid can also be used to collect hydrocarbons. In other cases, dedicated collection conduits can be used. In some examples, collecting hydrocarbon products from multiple locations at different heights within the body of crushed hydrocarbonaceous material can allow for different compositions of products to be collected at different locations. This can be caused by natural separation effects between hydrocarbons of different molecular weights, vapor pressures, dew points, etc. as the produced hydrocarbons flow through the particles of crushed hydrocarbonaceous material.

Figure 4:
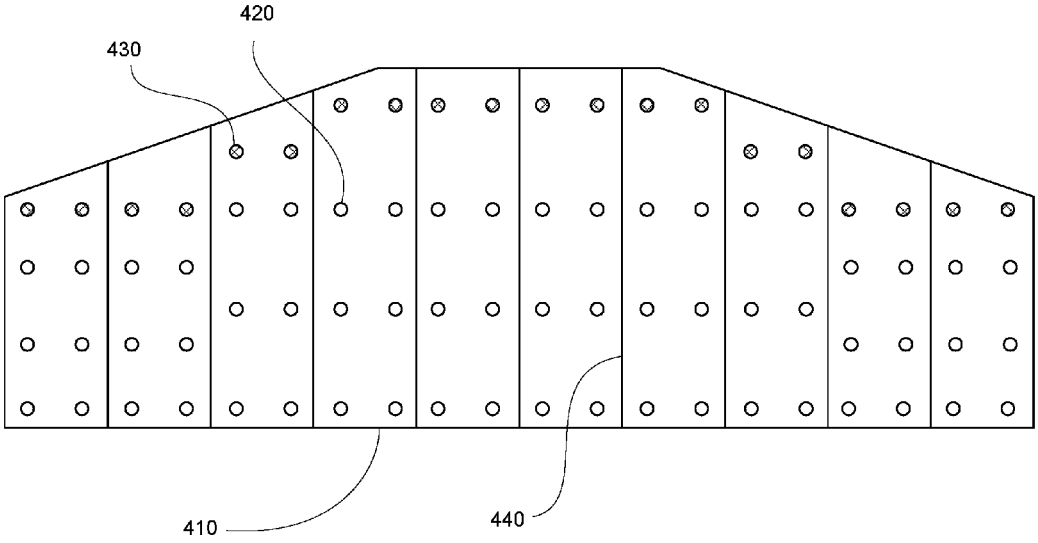
FIG. 4 is a cross-section illustration of a body of crushed hydrocarbonaceous material having heating conduits and collection conduits embedded therein, in accordance with an embodiment of the present invention.

FIG. 4 is a cross-section illustration of a body of crushed hydrocarbonaceous material 410 having heating conduits 420 and collection conduits 430 embedded therein, in accordance with an embodiment of the present invention. In this figure, the body of crushed hydrocarbonaceous material is subdivided into vertical slices 440. Each vertical slice includes three rows of heating conduits, with two heating conduits in each row. The rows are vertically spaced so that each row of heating conduits is configured to heat a different zone of the body of crushed hydrocarbonaceous material. In this particular embodiment, a lower row of heating conduits heats a lower zone, an intermediate row of heating conduits heats an intermediate zone, and an upper row of heating conduits heats an upper zone. A row of collection conduits is embedded in the upper zone, above the heating conduits.

It should be noted that this figure shows only one specific configuration of heating and collection conduits, and the present invention encompasses a variety of other configurations.

The present invention also extends to systems for heating a body of crushed hydrocarbonaceous material to produce hydrocarbons therefrom. Generally, such systems can include a body of crushed hydrocarbonaceous material having a lower zone and an upper zone. The systems can also include at least one heating conduit and at least one collection conduit so that the systems are capable of performing the methods described above. Furthermore, a system for heating a body of crushed hydrocarbonaceous material can include any components described above with respect to the methods of heating the body of crushed hydrocarbonaceous material. The systems can be configured to perform any of the methods described above.

In a particular embodiment, a system for heating a body of crushed hydrocarbonaceous material to produce hydrocarbons therefrom can include a body of crushed hydrocarbonaceous material. The body of crushed hydrocarbonaceous material can have a lower zone and an upper zone. A lower heating conduit can be embedded in the lower zone, and an upper heating conduit can be embedded in the upper zone. A collection conduit can be embedded in the upper zone at a location above the upper heating conduit. The system can also include a lower heating valve and an upper heating valve. These valves can be capable of switchably flowing heat transfer fluid through the lower and upper heating conduits, respectively. In other words, the valves can be turned on to allow heat transfer fluid to flow through the conduits, or the valves can be turned off to stop the flow. Further, the valves can be configured to sequentially allow the heat transfer fluid to flow through the lower heating conduit first, and then through the upper heating conduit or through the upper heating conduit first, and then through the lower heating conduit afterward. When this system is used to heat the body of crushed hydrocarbonaceous material, a high temperature production region can form in the lower zone when the heat transfer fluid flows through the lower heating conduit. Then, as the high temperature production region rises into the upper zone, the upper heating valve can be opened to supplementally heat the upper zone. The flow of heat transfer fluid to the lower zone can be stopped before the heat transfer fluid flows to the upper zone. Additionally, cooling fluid can be injected into the lower zone after stopping the flow of heat transfer fluid to the lower zone.

Figure 5:
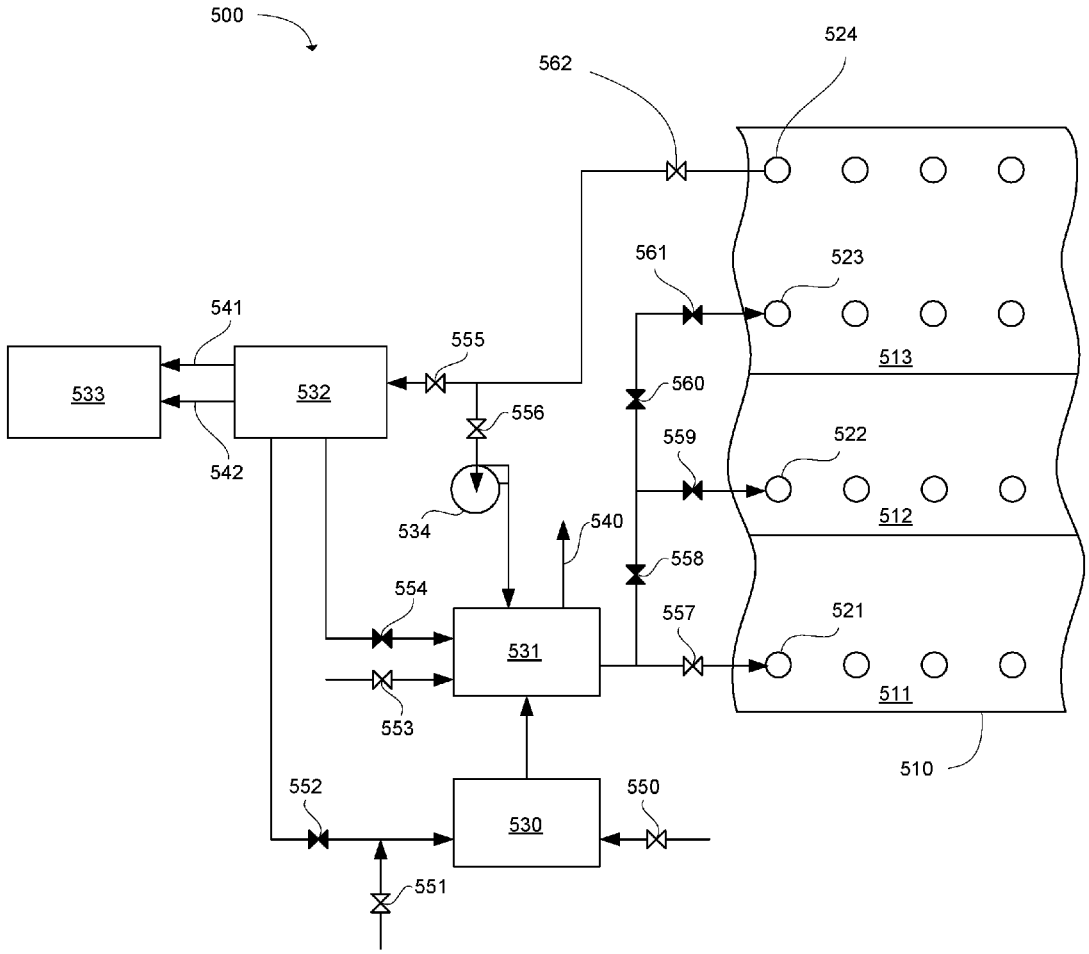
FIG. 5 is a schematic illustration of a system for heating a body of crushed hydrocarbonaceous material, in accordance with an embodiment of the present invention.

FIG. 5 is a schematic illustration of a system 500 for heating a body of crushed hydrocarbonaceous material 510, in accordance with an embodiment of the present invention. In the specific embodiment shown, the system includes a lower zone 511, an intermediate zone 512, and an upper zone 513. A row of lower heating conduits 521 is embedded in the lower zone; a row of intermediate heating conduits 522 is embedded in the intermediate zone; and a row of upper heating conduits 523 is embedded in the upper zone. Additionally, a row of collection conduits 524 is embedded in the upper zone above the upper heating conduits. The system shown in FIG. 5 also includes a burner 530, a boiler/super-heater 531, a separator 532, a storage vessel 533, and a pump 534. A variety of lines interconnect these process units. These lines include a flue gas vent 540, a water storage line 541, and an oil storage line 542, among others. Fluid flow through the lines can be controlled by valves 550, 551, 552, 553, 554, 555, 556, 557, 558, 559, 560, 561, and 562. Valve 550 allows combustion air to flow into the burner. Valve 551 allows natural gas fuel to flow to the burner. Valve 552 can open to allow non-condensable gases from the separator to be used as fuel in the burner. Valve 553 is a supply of air for use as a heat transfer fluid during preheating and cooling stages. Valve 554 allows condensed water from the separator to flow into the boiler/super-heater to make steam for use as a heat transfer fluid. Valve 555 directs gases from the collection conduits to enter the separator. Valve 556 directs gases from the collection conduits to the pump to be pumped back to the boiler/super-heater. Valves 557-561 can be opened in various combinations to flow heat transfer fluid into the lower, intermediate, and upper zones. Valve 562 controls the flow of gases from the collection conduits out of the body of crushed hydrocarbonaceous material.

FIG. 5 shows the system with a certain combination of valves opened or closed. The particular configuration of valves shown can be used for a preheating and purging stage. During this stage, air is heated and injected through the lower heating conduits at a temperature below production temperature. This preheating temperature can be, for example, from about 50° C. to about 250° C., or in some cases from about 100° C. to about 200° C. In one particular embodiment, the preheating temperature can be about 350° F. (177° C.). During the preheating stage, water can evaporate from the hydrocarbonaceous material, and a mixture of air and steam can be collected from the collection conduits. This mixture of air and steam can be recycled to the boiler/super-heater and re-injected into the lower heating conduits as the body of crushed hydrocarbonaceous material approaches the preheating temperature. In some embodiments, the ratio of steam to air can be slowly increased so that less air is injected as the body of crushed hydrocarbonaceous material reaches higher temperatures. By the end of the preheating stage, the concentration of air inside the body of crushed hydrocarbonaceous material can be reduced below a level that would support combustion or oxidation of the hydrocarbonaceous material or hydrocarbons produced therefrom. In one example, the body of material can be flushed of air until the concentration of oxygen in the body of material is below about 6% by volume.

Figure 6:
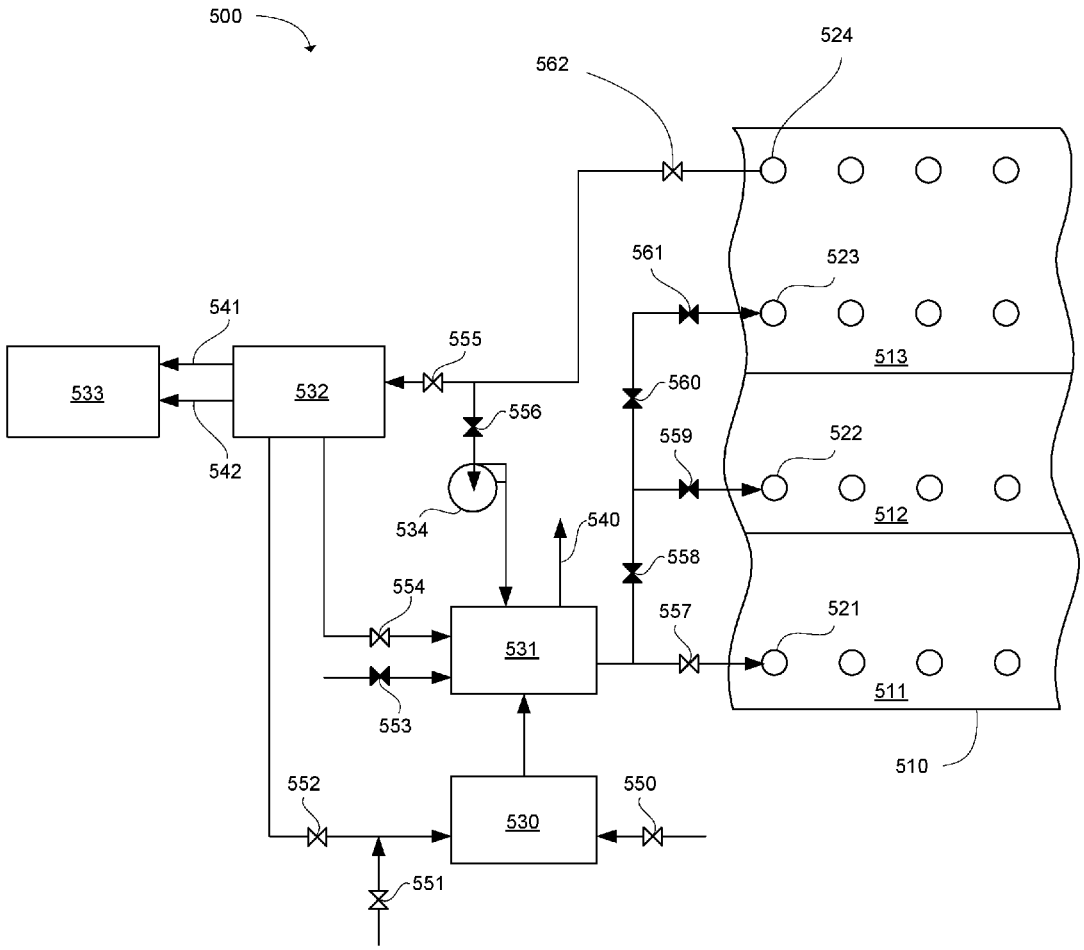
FIG. 6 is a schematic illustration of a system for heating a body of crushed hydrocarbonaceous material, in accordance with an embodiment of the present invention.

FIG. 6 shows the same system 500 with a different configuration of open and closed valves. This figure shows a first heating stage in which the lower zone 511 is heated. In this stage, valve 553 is closed to shut off air into the boiler/super-heater. Instead of using air as the heat transfer fluid, pure steam is used during this stage. The steam is formed by boiling and super-heating condensed water from the separator 532. The steam is injected through the lower heating conduits 521. As described above, this can cause a high temperature production region to form in the lower zone.

During the heating stage, the steam can be injected at a production temperature. The production temperature can be from about 95° C. to about 500° C. In more specific examples, the production temperature can be from about 100° C. to about 450° C. In still further examples, the production temperature can be from about 200° C. to about 400° C. In one particular embodiment, the temperature of the steam injected during this stage can be about 730° F. (388° C.). A mixture of steam and hydrocarbon products can be collected through the collection conduits 524. This mixture is separated as the separator 532 into water and hydrocarbons. Liquid hydrocarbons can be stored in storage vessel 533 while gaseous hydrocarbons can be used as fuel in the burner 530.

Figure 7:
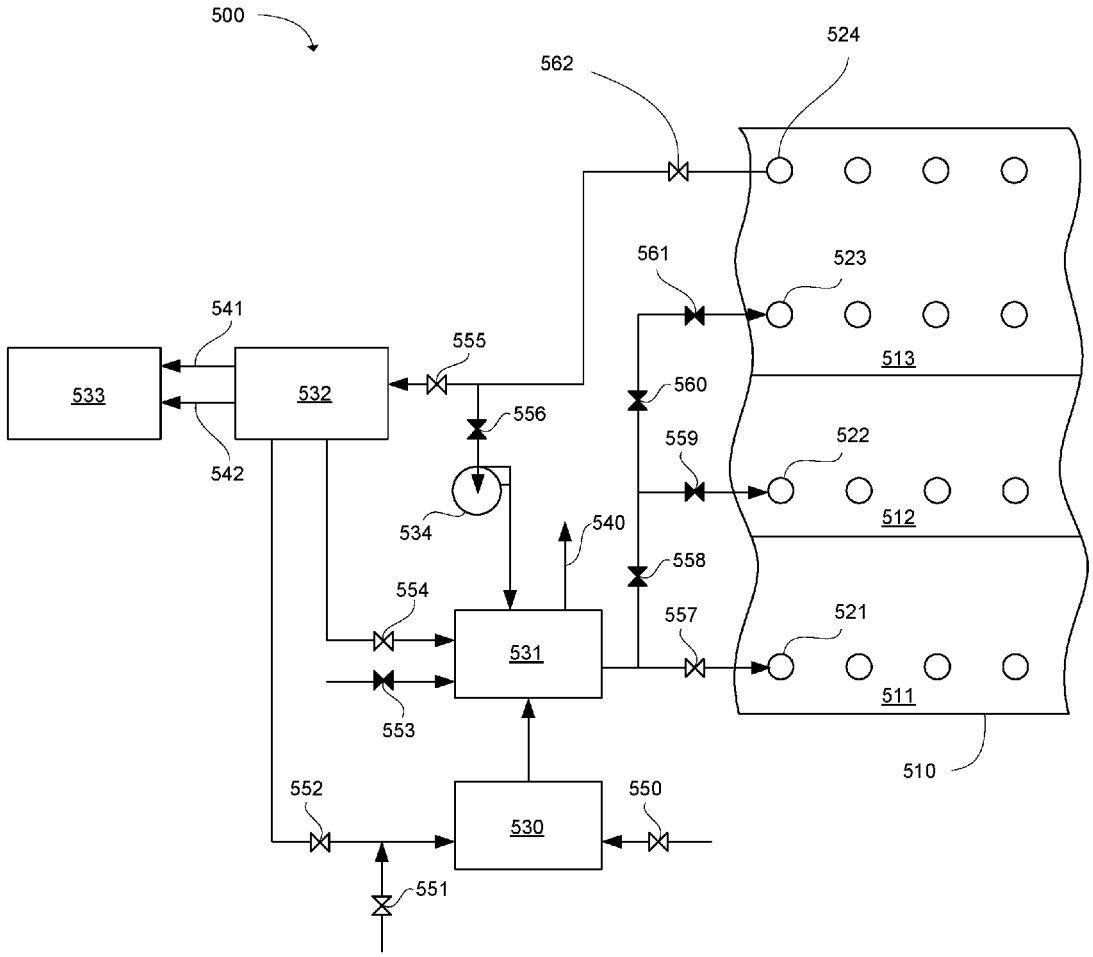
FIG. 7 is a schematic illustration of a system for heating a body of crushed hydrocarbonaceous material, in accordance with an embodiment of the present invention.

FIG. 7 shows a heat recovery stage, in which steam at a lower temperature is injected into the lower zone 511. During this stage, the high temperature production region can rise from the lower zone into the intermediate zone 512. The low temperature steam acts as a cooling fluid in the lower zone, and recovers heat from the lower zone. The steam can be at a cooling temperature from about 25° C. to about 250° C., or in some cases from about 100° C. to about 200° C. In one embodiment, the steam can be injected at about 300° F. (149° C.). During the heat recovery stage, a mixture of steam and hydrocarbon products continues to be collected from the collection conduits 524.

Figure 8:
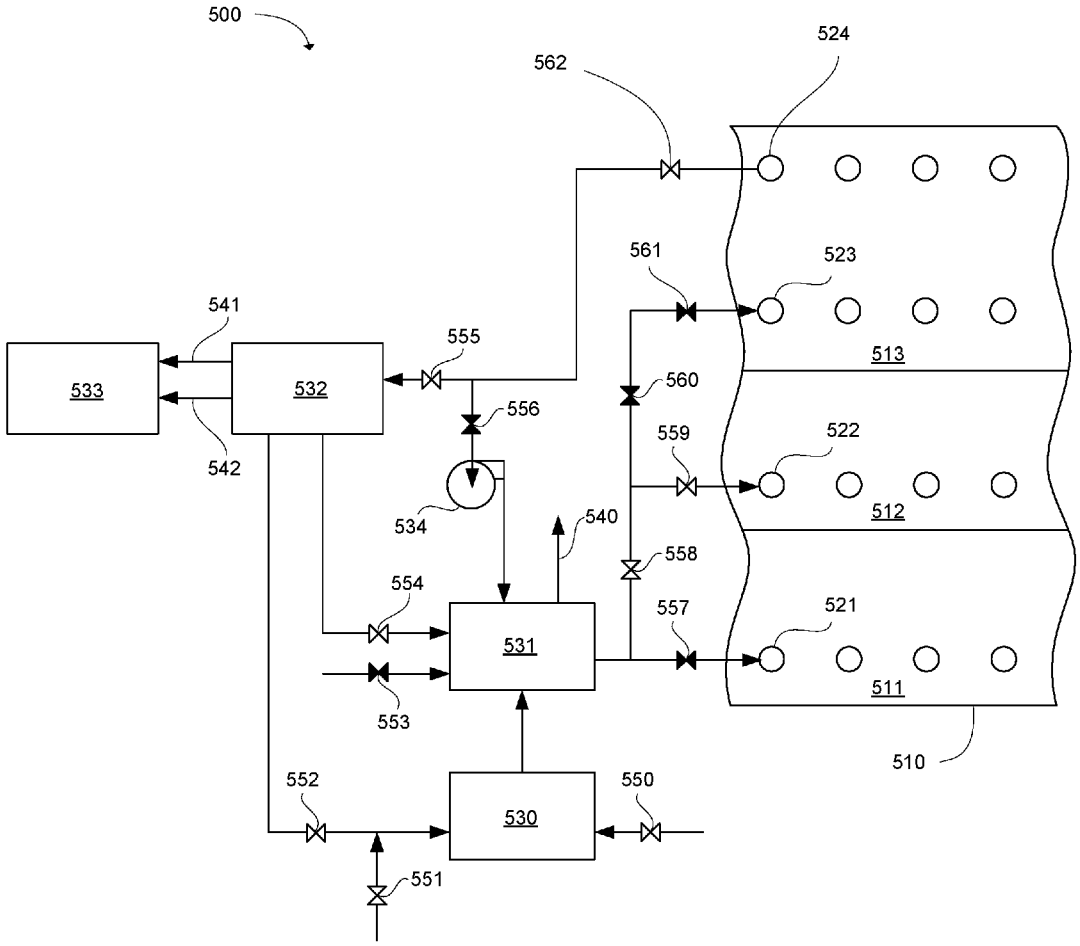
FIG. 8 is a schematic illustration of a system for heating a body of crushed hydrocarbonaceous material, in accordance with an embodiment of the present invention.

FIG. 8 shows an intermediate heating stage, in which high temperature steam is injected into the intermediate zone 512. The steam injected during this stage can be the same temperature as the steam injected during the first heating stage of the lower zone 511. During this stage, flow of steam to the lower zone is cut off so that steam is only injected into the intermediate zone. This avoids wasting energy on heating the hydrocarbonaceous material in the lower zone that has already been heated sufficiently to produce hydrocarbons therefrom.

Figure 9:
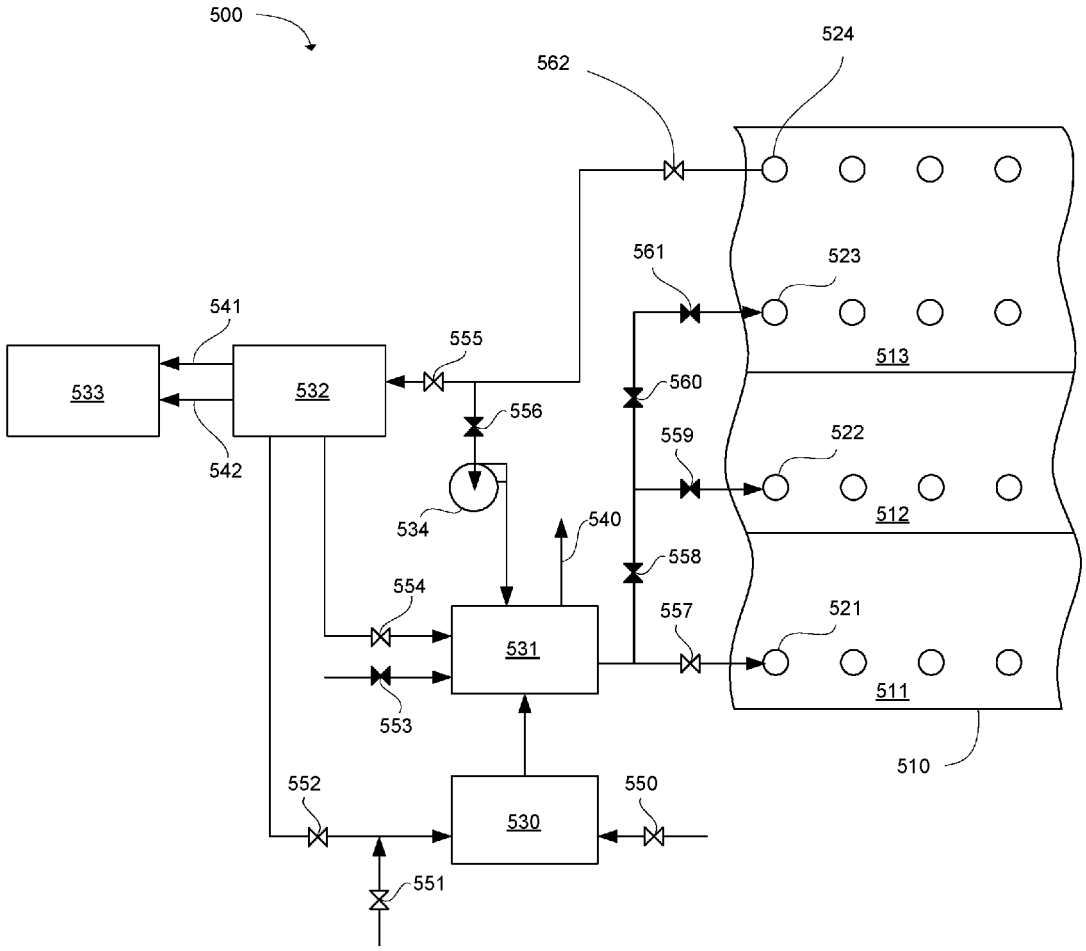
FIG. 9 is a schematic illustration of a system for heating a body of crushed hydrocarbonaceous material, in accordance with an embodiment of the present invention.

FIG. 9 shows another heat recovery stage. This heat recovery stage proceeds in the same way as the first heat recovery stage. Flow of steam to the intermediate zone 512 is shut off, and low temperature steam is injected in the lower zone 511. During this stage, the high temperature production region can move from the intermediate zone into the upper zone 513.

Figure 10:
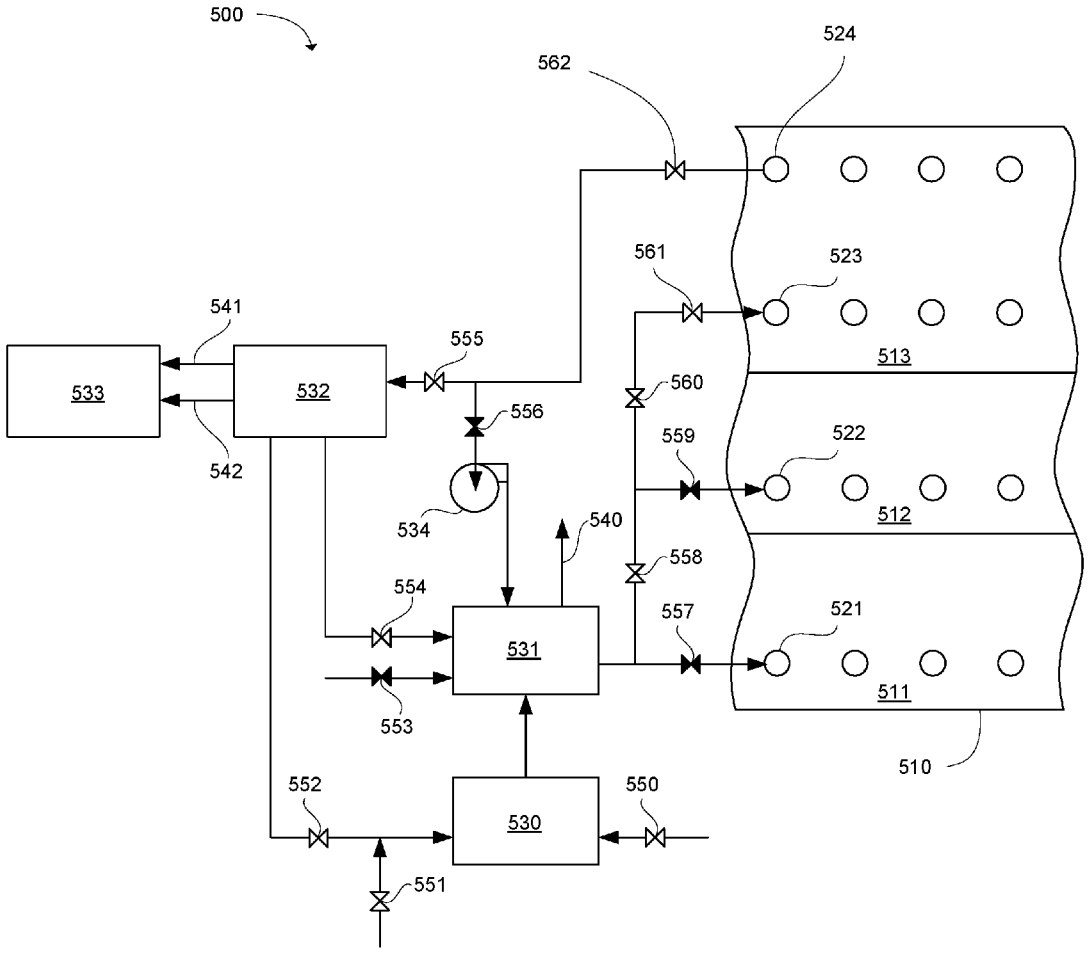
FIG. 10 is a schematic illustration of a system for heating a body of crushed hydrocarbonaceous material, in accordance with an embodiment of the present invention.

FIG. 10 shows the last heating stage in which the upper zone 513 is heated. High temperature steam is injected into the upper zone. Flow of steam to the lower zone 511 and intermediate zone 512 is shut off during this stage.

Figure 11:
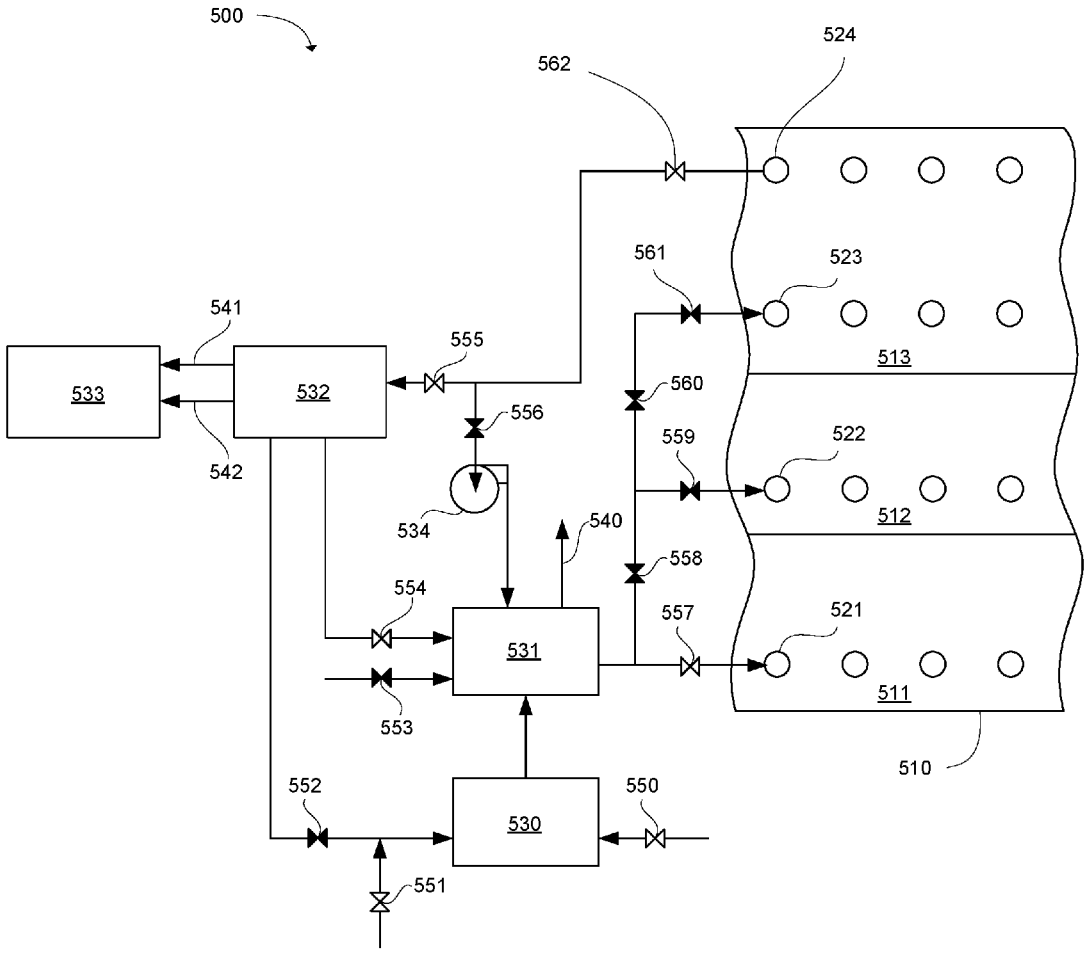
FIG. 11 is a schematic illustration of a system for heating a body of crushed hydrocarbonaceous material, in accordance with an embodiment of the present invention.
Figure 12:
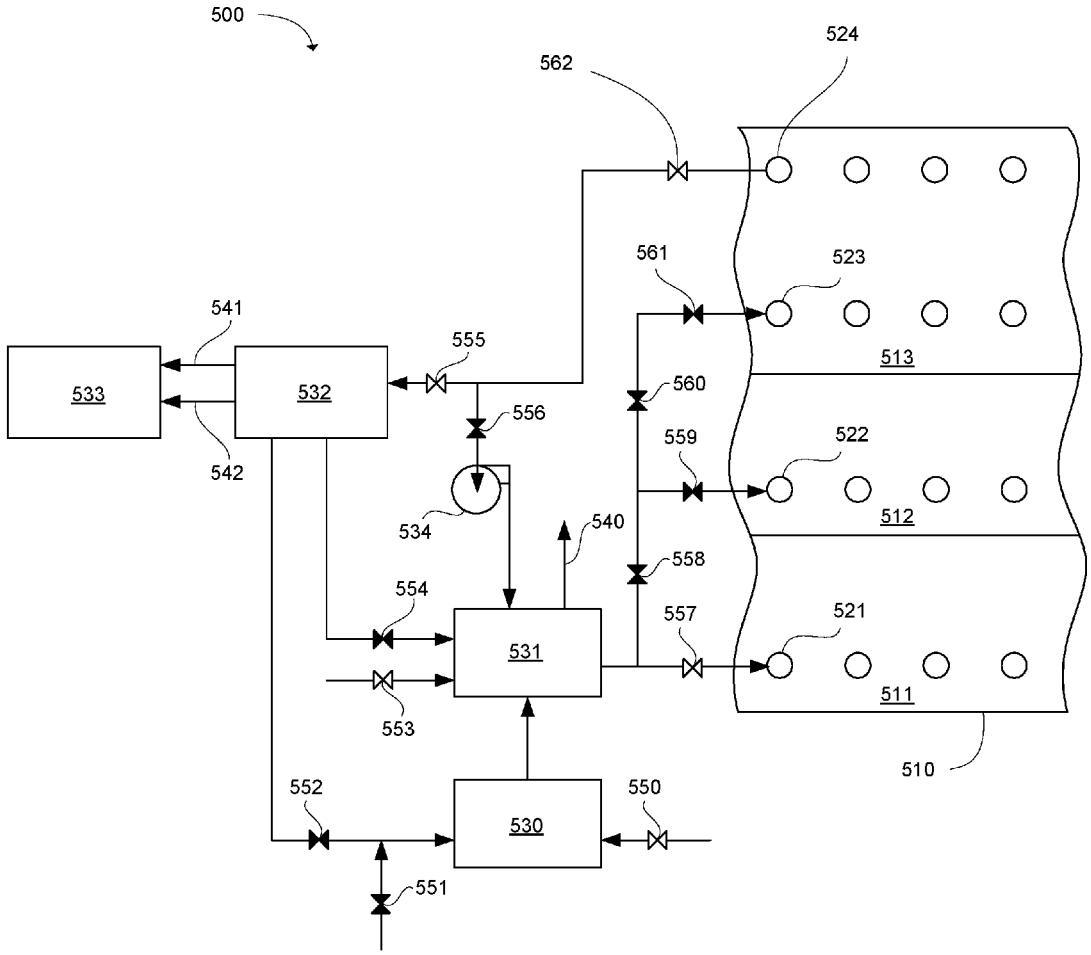
FIG. 12 is a schematic illustration of a system for heating a body of crushed hydrocarbonaceous material, in accordance with an embodiment of the present invention.

FIG. 11 shows a final cooling stage. Once again, low temperature steam is injected into the lower zone 511. This can be continued until the entire body of crushed hydrocarbonaceous material is below a certain temperature. For example, steam can be used to cool the body of material to a temperature within about 25° C. of the steam temperature. In one example, the steam can be at a temperature of about 300° F. (149° C.) and the cooling can continue until the body of material reaches about 350° F. (177° C.). At this point, lower temperature air, such as ambient temperature air, can be used to cool the body of material down to a final temperature. FIG. 12 shows a configuration in which air is injected into the lower zone to cool the body of material. In one example, ambient air can be used to cool the body of material to below about 200° F. (93° C.).

The above figures show one embodiment of the present invention. Other configurations of process equipment, heating zones, lines, and valves can be used. For example, the body of crushed hydrocarbonaceous material can be divided into any number of zones or heated in any zone sequence. Systems for heating the hydrocarbonaceous material can include any suitable arrangement of valves configured to sequentially heat the zones. In some embodiments, a heat recovery stage can be performed between each heating stage by injecting a lower temperature cooling fluid into the body of material. The cooling fluid can be injected into the lower or upper zone during each heat recovery stage, or the cooling fluid can be injected into intermediate zones.

Figure 13:
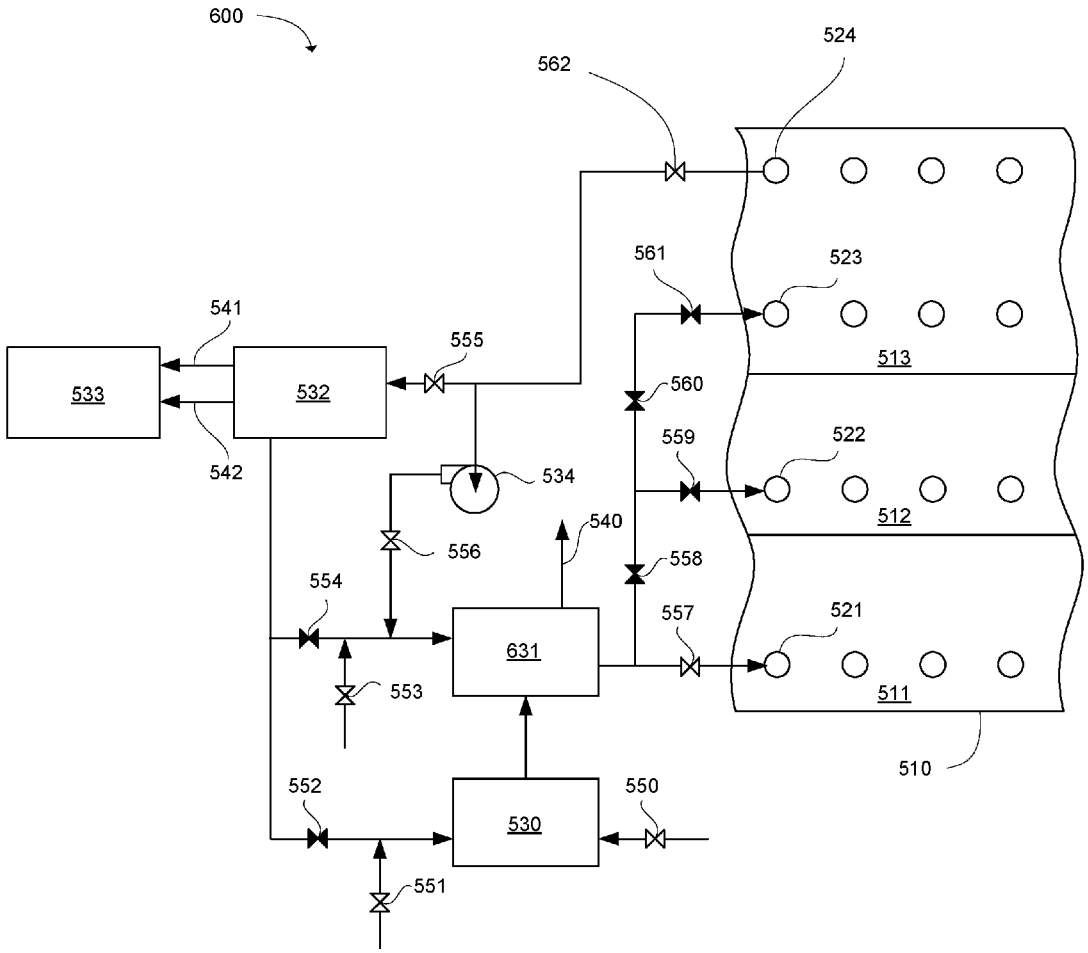
FIG. 13 is a schematic illustration of a system for heating a body of crushed hydrocarbonaceous material, in accordance with an embodiment of the present invention.

FIG. 13 shows another embodiment of a system 600 for heating a body of crushed hydrocarbonaceous material, in accordance with an embodiment of the present invention. In this embodiment, the process equipment is configured to allow non-condensable gases from the separator 532 to be used as heat transfer fluid during the heating stages. Valve 554 can be opened to allow non-condensable gases to be directed to indirect fired heat exchanger 631 to heat the non-condensable gases, which can then be injected into the body of crushed hydrocarbonaceous material 510. Valve 553 allows air to be used as a heat transfer fluid during a preheating stage. Valve 556 allows gases collected from the collection conduits 524 to be recycled and re-used as heat transfer fluid.

The system shown in FIG. 13 can be used for a similar hydrocarbon production process as shown in FIGS. 5-12, although each individual step of the process is not illustrated in FIG. 13. In a preheating and purging stage, air can be heated in the indirect fired heat exchanger 631 and injected into the lower zone 511. A mixture of air and steam from evaporating water in the body of crushed hydrocarbonaceous material 510 can be collected from the collection conduits 524 and recycled to the indirect fired heat exchanger. This preheating and purging stage can be performed using the same preheating temperatures described above. Other process units shown in FIG. 13 correspond to the process units in the system of FIGS. 5-12.

Following preheating, a first heating stage can be performed by switching the valves to cut off flow of air to the indirect fired heat exchanger 631 and instead use non-condensable gases from the separator 532 as the heat transfer fluid. The non-condensable gases can be heated to a production temperature and injected into the first zone 511 or 513. The production temperature can be any of the production temperatures described above. In a further specific embodiment, the temperature of the non-condensable gases can be about 900° F. (482° C.). After the heating stage, cooler non-condensable gases can be injected as a cooling fluid into the lower or upper zone during a heat recovery stage. The cooling fluid can have a cooling temperature as described above. In one specific embodiment, the temperature of the cooling fluid can be about 110° F. (43° C.). Additional heating stages and cooling stages can be performed for the intermediate zone 512 and upper zone 513 as described above.

Figure 14:
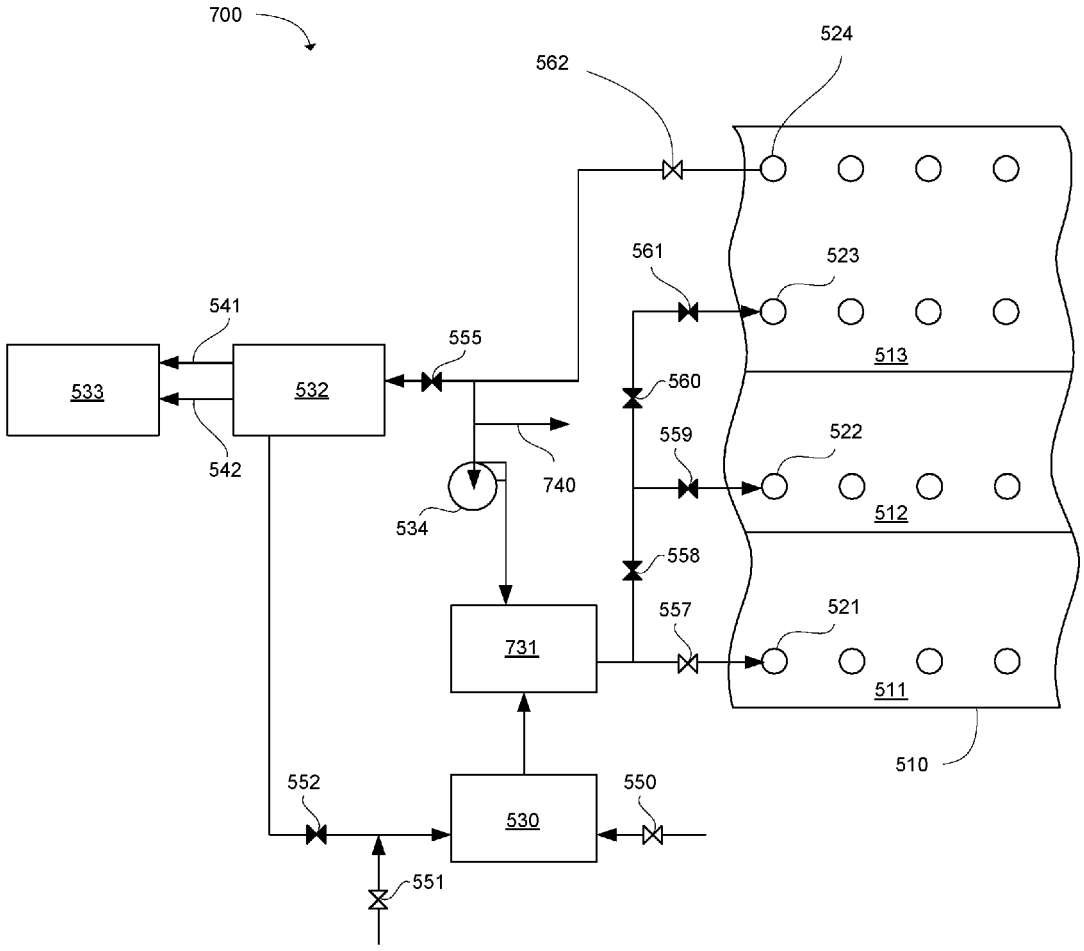
FIG. 14 is a schematic illustration of a system for heating a body of crushed hydrocarbonaceous material, in accordance with an embodiment of the present invention.
Figure 15:
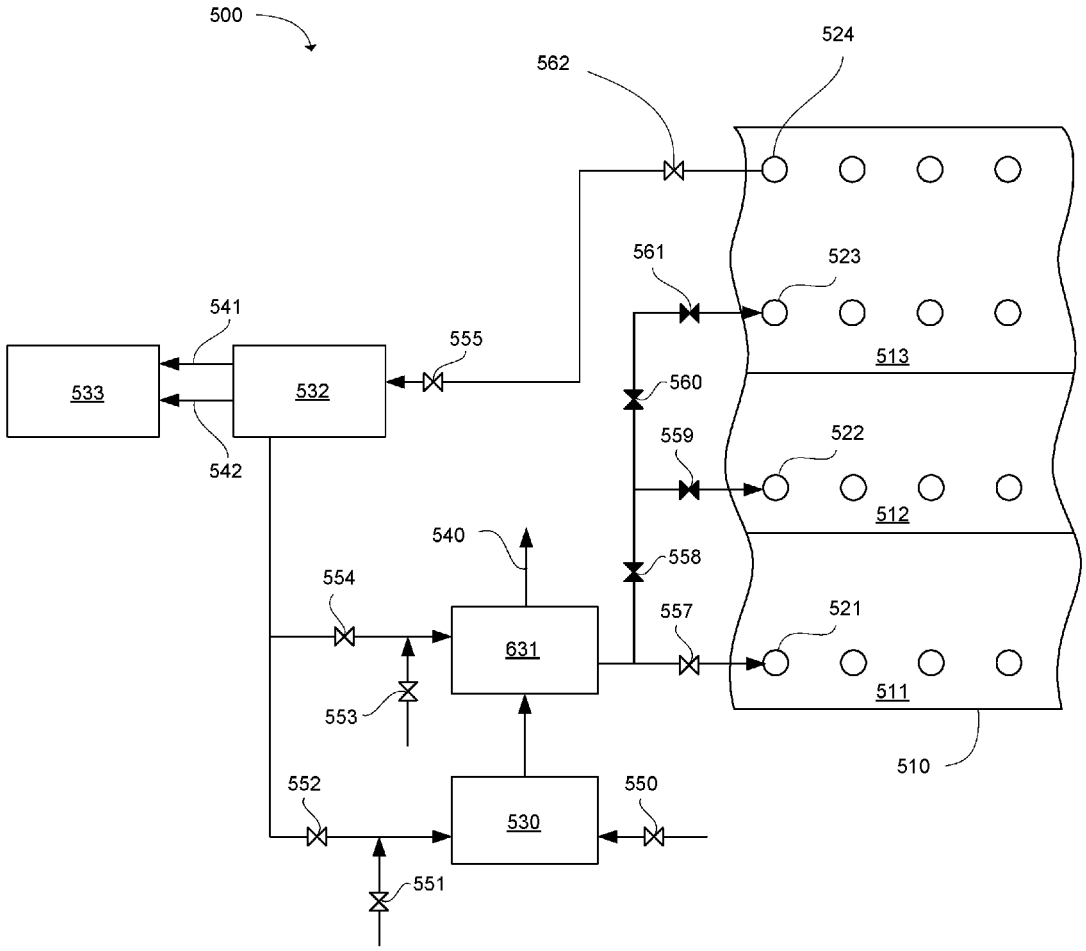
FIG. 15 is a schematic illustration of a system for heating a body of crushed hydrocarbonaceous material, in accordance with an embodiment of the present invention.

FIG. 14 shows another embodiment of a system 700 for heating a body of crushed hydrocarbonaceous material. In this embodiment, exhaust from the burner 530 is directed to a mixing chamber 731 where the exhaust is mixed with a sufficient amount of non-oxidizing gas (e.g. gas not containing oxygen) to make a mixture having a preheating temperature. The preheating temperature can be any of the preheating temperatures described above. In one specific embodiment, the preheating temperature can be about 400° F. (204° C.). The burner exhaust can be at a combustion temperature, such as from about 1000° C. to about 1500° C. In one specific embodiment, the exhaust temperature can be about 2500° F. (1371° C.). After the preheating stage, this system stops using burner exhaust mixed with non-oxidizing gas as the heat transfer fluid, and switches to the configuration shown in FIG. 15. In FIG. 15, the burner exhaust is directed to an indirect fired heat exchanger 631 instead of the mixing chamber. The indirect fired heat exchanger is used to heat non-condensable gases from the separator 532. After running through the indirect fired heat exchanger, the exhaust gas exits out the flue gas vent 540. Additional natural gas to be used as a heat transfer fluid can be added using valve 553. Other process units shown in FIG. 15 correspond to the process units used in FIGS. 13-14. Using this configuration, the system can perform heating and cooling stages for each of the zones of the body of crushed hydrocarbonaceous material 510 as described above.

In systems using direct heating by injection of heat transfer fluid, the heating conduits can be configured to provide uniform injection throughout the zone being heated. In some examples, this can be accomplished by using heating conduits with relatively small perforations for injection of heat transfer fluid. The size of the perforations can be controlled so that fluid is injected out of each perforation at roughly the same mass flow rate. In one example, the total area of the perforations can be significantly less than the cross-sectional area of the conduit. In some cases, the total area of all perforations in a conduit can be less than the cross-sectional area of the conduit. In a specific example, the total area of all perforations in a conduit can be less than 60% of the cross sectional area of the conduit, and in other cases from about 30% to 60%. In another specific example, the flow rate from each perforation along the entire length of the body of crushed hydrocarbonaceous material can be within 10% of the mean flow rate from the perforations.

In further examples, the heating conduits can have a diameter from about 10" to about 40". In more specific examples, the heating conduits can have a diameter from about 12" to about 36". In still further examples, the heating conduits can have a diameter from about 12" to about 20". The perforations can also vary in size. In some examples, the perforations can be from about 4 mm to about 10 mm in diameter. Collection conduits can vary in diameter from about 10" to about 40". In some cases, the collection conduits can include larger perforations compared to the heating conduits. In some examples, the collection conduits can have perforations from about 1" to about 3" in diameter. In one specific example, the collection conduits can have perforations about 2.6" in diameter.

In further examples, the perforations can be located on a lower surface of the conduit. Placing the perforations on the lower surface instead of the upper surface can help prevent clogging of the perforations with dust or small particles of hydrocarbonaceous material. Collection conduits can also have perforations on a lower surface to reduce entry of particulate material into the product stream.

Figure 16A:
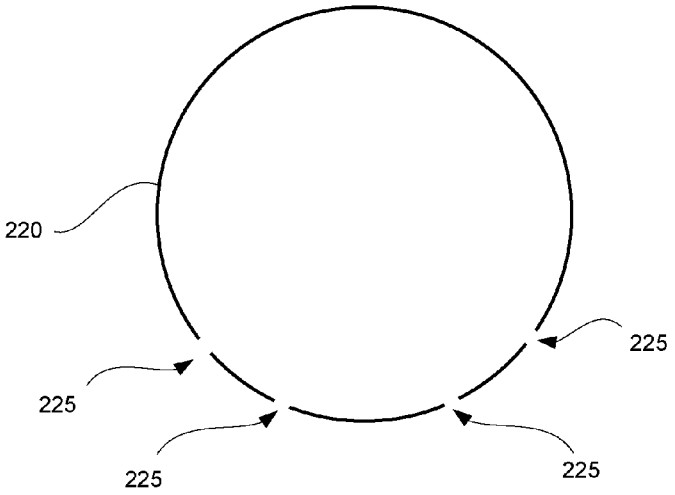
FIG. 16A is a cross-sectional view of a heating conduit in accordance with an embodiment of the present invention.
Figure 16B:
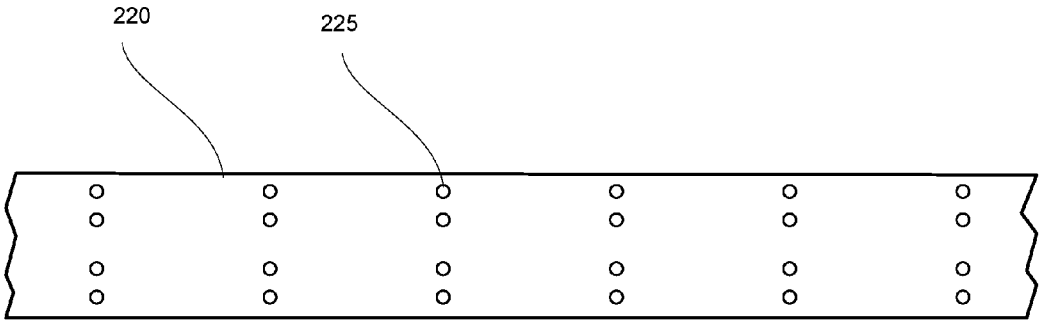
FIG. 16B is a bottom plan view of a heating conduit in accordance with an embodiment of the present invention.

FIG. 16A is a cross-sectional view of a heating conduit 220 having four perforations 225 distributed radially on a lower surface of the conduit. FIG. 16B is a bottom plan view of this heating conduit, showing that the conduit has multiple sets of four perforations distributed at a plurality of axial locations along the conduit.

All aspects of the systems described above, including process equipment, valve configurations, and design of heating and collection conduits, can be applied to methods of heating a body of crushed hydrocarbonaceous material. Similarly, method steps can be applied to the systems described herein. Thus, the present invention encompasses methods and systems incorporating any of the method steps and system elements described herein.

EXAMPLES

Heat transfer fluid is supplied to a body of crushed oil shale at a flow rate of 288,000 lb/hr at 900° F. Table 1 shows three options for heating conduit diameter with corresponding supply pressures, perforation diameters, conduit inlet velocities, and perforation velocities (velocity of fluid flowing through perforations).

TABLE 1

| Conduit Diameter | Supply Pressure | Perforation Diameter | Conduit Inlet Velocity | Perforation Velocity |
|---|---|---|---|---|
| 20" | 1.0 psig | 8 mm | 41 m/s | 87-81 m/s |
| 16" | 2.1 psig | 6 mm | 63 m/s | 150-135 m/s |
| 12" | 8.7 psig | 4 mm | 113 m/s | 335-305 m/s |

Table 2 shows two options for collection conduit diameter, with corresponding number of collection conduits in the system, perforation diameter, conduit maximum velocity, and perforation velocity.

TABLE 2

| Conduit Diameter | No. of Conduits | Perforation Diameter | Conduit Max Velocity | Perforation Velocity |
|---|---|---|---|---|
| 26" | 20 | 2.6" | 20 m/s | <1 m/s |
| 36" | 20 | 2.6 | 10 m/s | <1 m/s |

Table 3 shows a pressure balance for an impoundment having the 20" heating conduits described above embedded therein.

TABLE 3

| | |
|---|---|
| Working fluid supply pressure | 1 psig |
| Pressure drop across injection conduit perforations | 0.5 psig |
| Pressure drop through oil shale bed (assuming 35% porosity) | <0.1 psig |
| Pressure drop through collection conduits | <0.2 psig |
| Impoundment outlet gas pressure | >0.2 psig and <0.5 psig |

The described features, structures, or characteristics may be combined in any suitable manner in one or more examples. In the preceding description numerous specific details were provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of heating a body of crushed hydrocarbonaceous material to produce hydrocarbons therefrom, comprising:

forming a body of crushed hydrocarbonaceous material having a first zone and a second zone;

heating the first zone during a first heating stage to form a dynamic high temperature production region in the first zone;

injecting a cooling fluid into the first zone after the high temperature production region forms such that the high temperature production region moves into the second zone in a second heating stage; and collecting hydrocarbons from the body of crushed hydrocarbonaceous material during both the first and second heating stages.

2. The method of claim 1, wherein the first zone is a lower zone of the body of crushed hydrocarbonaceous material and the second zone is an upper zone of the body of crushed hydrocarbonaceous material, and the high temperature production region moves upward into the upper zone during the second heating stage.

3. The method of claim 1, wherein the first zone is an upper zone of the body of crushed hydrocarbonaceous material and the second zone is an lower zone of the body of crushed hydrocarbonaceous material, and the high temperature production region moves downward into the lower zone during the second heating stage.

4. The method of claim 1, wherein the heating is performed using at least one heating conduit embedded in the first zone.

5. The method of claim 4, wherein the heating conduit is a closed loop heating conduit configured to heat the first zone by indirect heating.

6. The method of claim 4, wherein the heating conduit is an injection conduit configured to heat the first zone by injecting a heat transfer fluid.

7. The method of claim 6, wherein the heat transfer fluid comprises air, steam, light hydrocarbons, carbon dioxide, hydrogen or mixtures thereof.

8. The method of claim 1, further comprising supplementally heating the second zone while the high temperature production region is at least partially within the second zone.

9. The method of claim 1, wherein the high temperature production region moves through at least one intermediate zone between the first zone and the second zone, the method further comprising supplementally heating the at least one intermediate zone while the high temperature production region is at least partially within the at least one intermediate zone.

10. The method of claim 9, wherein collecting the hydrocarbons comprises collecting hydrocarbons from the at least one intermediate zone.

* * * * *